US012751527B2

(12) United States Patent
King et al.

(10) Patent No.: US 12,751,527 B2
(45) Date of Patent: Oct. 6, 2026

(54) MULTIPLE PURPOSE TRAVEL BAGS, TRAVEL BAG SYSTEMS, AND RELATED METHODS

(71) Applicant: Stitch Golf Holdings, Inc., Apex, NC (US)

(72) Inventors: Bradley King, Cary, NC (US); Tanner Foster, Raleigh, NC (US); Grant Zechman, Raleigh, NC (US); Charles Burgwyn, Cary, NC (US)

(73) Assignee: Stitch Golf Holdings, Inc., Apex, NC (US)

( * ) Notice: Subject to any disclaimer, the term of this patent is extended or adjusted under 35 U.S.C. 154(b) by 0 days.

(21) Appl. No.: 17/894,598

(22) Filed: Aug. 24, 2022

(65) Prior Publication Data

US 2024/0065395 A1 Feb. 29, 2024

(51) Int. Cl.
*A45C 7/00* (2006.01)
*A45C 3/00* (2006.01)
(Continued)

(52) U.S. Cl.
CPC ..... *A45C 7/0036* (2013.01); *A45C 5/03* (2013.01); *A45C 5/14* (2013.01); *A45C 2003/008* (2013.01)

(58) Field of Classification Search
CPC ..... A45C 7/0036; A45C 5/03; A45C 5/14; A45C 2003/008
(Continued)

(56) References Cited

U.S. PATENT DOCUMENTS

D264,146 S 5/1982 Davis
4,679,242 A * 7/1987 Brockhaus ..... A45C 7/0059 383/18
(Continued)

FOREIGN PATENT DOCUMENTS

CN 305481905 12/2019
CN 307410037 6/2022
(Continued)

OTHER PUBLICATIONS

ASDMM: https://www.amazon.com/Travel-Support-Aluminum-Adjustable-System/dp/B07Q5M1VMD/ref=sr_1_16?crid=C3CFSPBW0BR&keywords=golf%2Bbag%2Bsupport%2Bpole&qid=1695242104&sprefix=golf%2Bbag%2Bsupport%2Bpole%2Caps%2C122&sr=8-16&th=1 (Year: 2019).*
(Continued)

*Primary Examiner* — Nathan J Jenness
*Assistant Examiner* — Jessica Kavini Tamil
(74) *Attorney, Agent, or Firm* — Michael Best & Friedrich LLP

(57) ABSTRACT

Multipurpose travel bags, travel bags systems, and related methods are provided herein. A multipurpose travel bag can include a top receptacle portion having a top wall, sidewalls, and an openable floor and a base having an open base cavity therein that faces upward. The multipurpose travel bag can include a collapsible chassis attached to the top receptacle portion and the base. The collapsible chassis has sidewalls that are extendable and retractable between an extended position and a retracted position such that the collapsible chassis fits into the cavity of the base when the collapsible chassis is collapsed into the retracted position. The top receptacle portion can be attached to the base. When collapsed, the collapsible chassis can fit in the base cavity to form a smaller travel bag when the collapsible chassis is in
(Continued)

the retracted position. The top receptacle portion can detach from the base so that the collapsible chassis can be extended to the extended position to form a larger travel bag.

19 Claims, 16 Drawing Sheets

(51) Int. Cl.
*A45C 5/03* (2006.01)
*A45C 5/14* (2006.01)

(58) Field of Classification Search
USPC ..... 190/107
See application file for complete search history.

(56) References Cited

U.S. PATENT DOCUMENTS

| | | | | |
|---|---|---|---|---|
| 5,105,919 | A | 4/1992 | Bomes et al. | |
| 6,009,995 | A | 1/2000 | Speck | |
| D421,838 | S | 3/2000 | Bradshaw et al. | |
| D501,603 | S | 2/2005 | Shamas | |
| D512,220 | S | 12/2005 | Van Himbeeck | |
| D532,970 | S | 12/2006 | Teitloff et al. | |
| D688,457 | S | 8/2013 | Harris | |
| 8,967,375 | B1 | 3/2015 | Nitkin | |
| D729,519 | S | 5/2015 | Clough et al. | |
| D731,181 | S | 6/2015 | Majeau et al. | |
| D754,435 | S | 4/2016 | Maguire | |
| D757,432 | S | 5/2016 | Hansen | |
| D758,725 | S | 6/2016 | Lin | |
| D822,990 | S | 7/2018 | Mather | |
| D834,818 | S | 12/2018 | Freitag et al. | |
| D936,966 | S | 11/2021 | Yuval | |
| D953,026 | S | 5/2022 | Dumas | |
| D964,030 | S | 9/2022 | Thibadeau et al. | |
| 2002/0144916 | A1 | 10/2002 | Cheng | |
| 2004/0108179 | A1* | 6/2004 | Scicluna | A45C 7/0054 190/115 |
| 2004/0134811 | A1* | 7/2004 | Lai | A63B 55/00 206/315.3 |
| 2014/0001001 | A1* | 1/2014 | Turpeau | A45C 7/0059 190/104 |
| 2015/0060221 | A1 | 3/2015 | Bourette | |
| 2016/0206060 | A1 | 7/2016 | Mcguire et al. | |
| 2017/0342607 | A1* | 11/2017 | Yamada | D03D 15/283 |
| 2019/0289970 | A1 | 9/2019 | Mcguire et al. | |

FOREIGN PATENT DOCUMENTS

| | | | | |
|---|---|---|---|---|
| EM | 000771662-0003 | | 8/2007 | |
| GB | 6201766 | | 4/2022 | |
| WO | WO-2004030488 | A2 * | 4/2004 | A45C 13/02 |

OTHER PUBLICATIONS

The Stitch M UT Bag—Posted by James Miles, The Hackers Paradise, Publication Date Nov. 1, 2022, thehackersparadise.com, [online], [site visited Jan. 25, 2024], Available from internet URL <https://www.thehackersparadise.com/ the-stitch-mut-bag/> (Year: 2022).

Darekuku Padded Golf Travel Bags with Wheels . . . Extra Storage Pocket—Amazon, Date First Available Sep. 16, 2021, amazon.com, [online], [site visited Jan. 25, 2024], Available from internet URL <https://www.amazon.com/dp/B09GFCN7WT?_ encoding= UTF8 &ref_=cm_sw_r_cp_ud_dp_VK16JHXG371XHOTJ8BVQ&th= 1> (Year: 2021).

* cited by examiner

MULTIPLE PURPOSE TRAVEL BAGS, TRAVEL BAG SYSTEMS, AND RELATED METHODS

TECHNICAL FIELD

The presently disclosed subject matter relates to multiple purpose travel bags, travel bag systems, and related methods. In particular, the present subject matter relates to travel bags that can be converted from smaller travel luggage to larger golf travel bags for packing golf bags with golf clubs therein.

BACKGROUND

Golfing has been a popular sport for over a century. As golf became more popular through televised professional golf matches around the world, more people desired to play the historic golf courses across the United States and the world that they saw on their televisions. Additionally, as golf has become more popular, many people began to play golf on their vacations to give them a chance to play other uniquely designed courses other than the golf courses found within short driving distances from their homes. For these reasons, over the last few decades, leisure golf-related travel has become increasingly popular.

Traditionally, golfing requires a golf bag to carry a set of clubs. Golf bags are standard equipment in the game of golf for holding and transporting golf clubs. For long distance travel, though, a normal golf bag does not provide the needed protection for the golf clubs. While technically a rain cover over the top of a golf bag can provide some protection, for any travel where the golfer does not have control over the packing and storing of the golf bag, such as during air travel, a travel bag for the golf bag is needed. Golfers cannot take their golf clubs in an airplane cabin under federal regulations, so the golf bag with the golf clubs therein must go in the hold, putting the golfer's investment in their clubs in the hands of a third party air carrier. In fact, some airlines are starting to require certain types of golf bag travel bags if the airlines are going to guarantee the safe arrival of a golfer's clubs. Thus, a new industry of travel bags for golf bags has developed to serve the need of golfers to protect their investment in golf clubs as they travel.

Golf bag travel bags are available in both hard cases and soft cases in a wide variety of designs. Hard cases provide the most protection for a golfer's golf bag and clubs, but these types of golf travel bags are expensive and are heavy and bulky making them hard to handle. In fact, some hard cases are so big and bulky that they have trouble fitting into the trunks of some smaller cars.

Soft cases can be a viable alternative to the hard case. Soft cases generally tend to be less expensive and are easily to handle and store. Soft cases can provide as much protection as some hard cases, while being cheaper and lighter weight due to their construction and design. Even though soft case golf bag travel bags are cheaper than hard cases, the price for these types of travel bags is still high for the average golfer who may use the travel bag for their golf bag and clubs one, two, three or, maybe, four times a year. Many people would rather invest the amount of money needed to invest in a quality travel bag for a golf bag in an item that can be used more frequently but are trapped into the investment if they plan to travel to play golf in other locations and golf-centric destinations.

Accordingly, a need remains for a travel bag that can be used to carry and protect a golf bag and the golf clubs therein and that can also provide other uses. Disclosed herein are multipurpose travel bags that can address these needs.

SUMMARY

The presently disclosed subject matter relates to multiple purpose travel bags, travel bag systems, and related methods. In particular, the present subject matter relates to travel bags that can be converted from travel luggage to golf travel bags for packing golf bags with golf clubs therein. Methods related to the manufacture and use of the multiple purpose travel bags as disclosed herein are also provided.

While one or more objects of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

Figure 1:
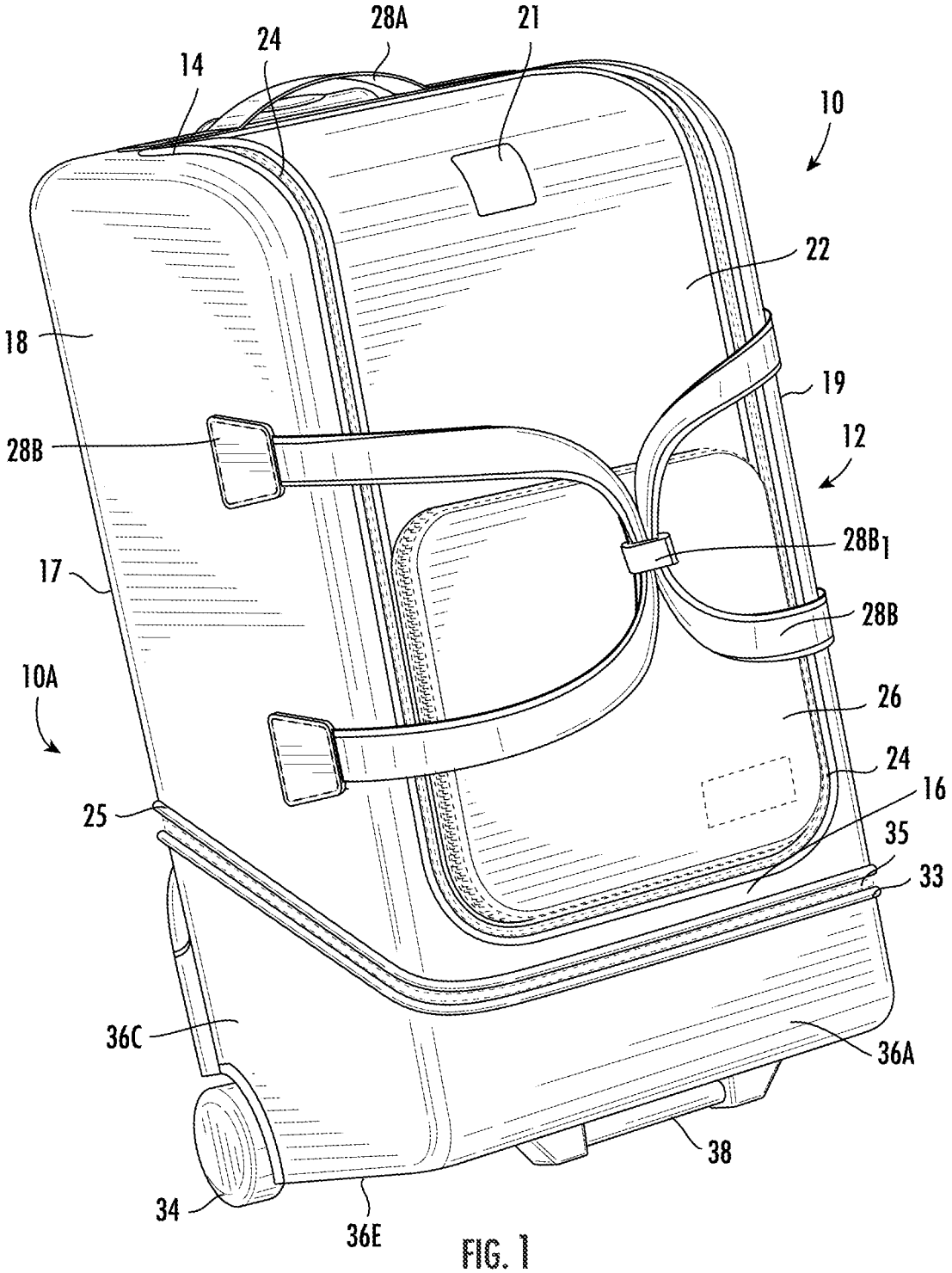
FIG. 1 illustrates a front left side perspective view of an embodiment of a multipurpose travel bag that has been converted to a smaller travel bag according to the present subject matter.
Figure 2:
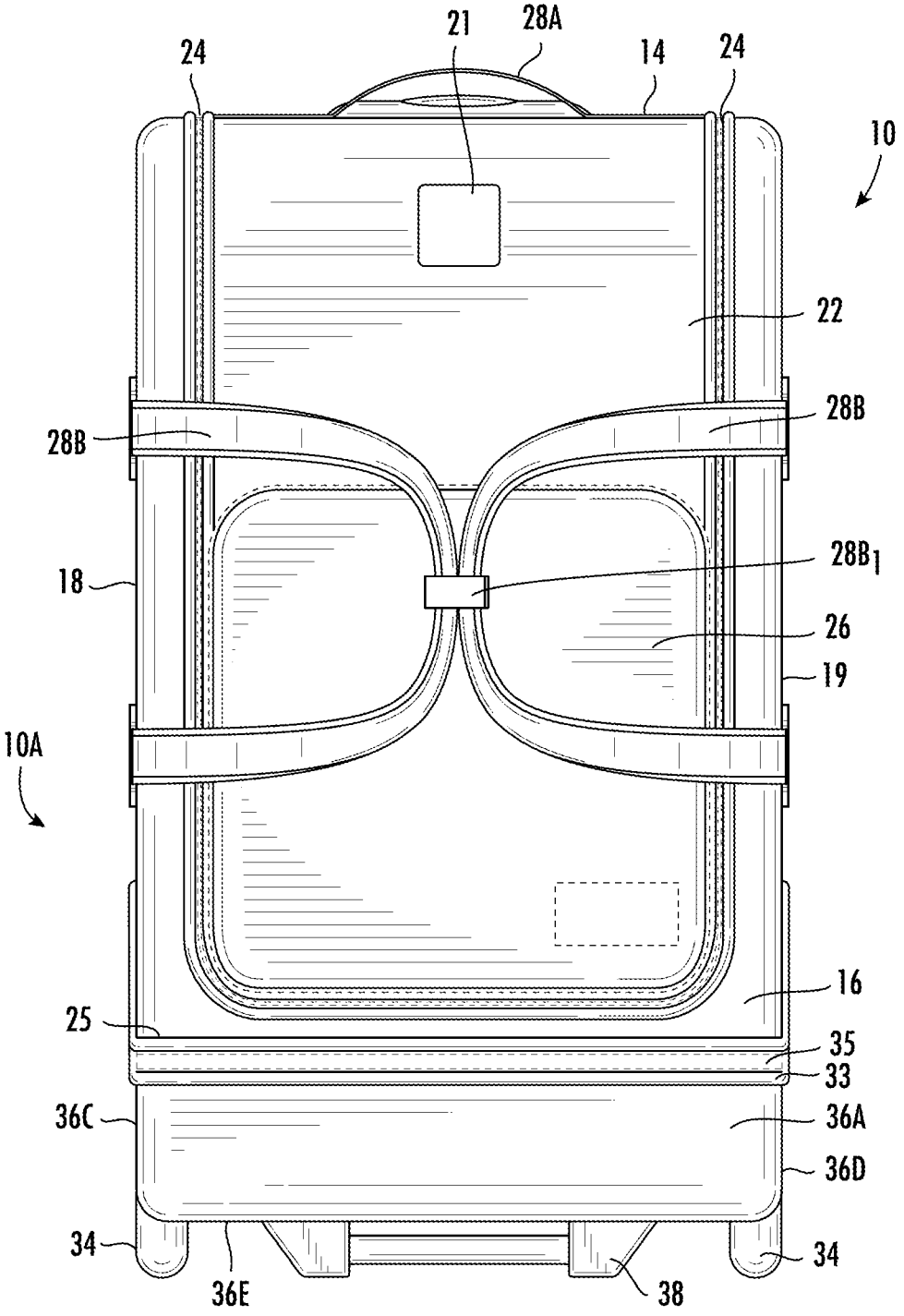
FIG. 2 illustrates a front side plan view of the embodiment of the multipurpose travel bag that has been converted to a smaller travel bag according to FIG. 1.

Repeat use of reference characters in the present specification and drawings is intended to represent the seam or analogous features or elements of the present subject matter.

DETAILED DESCRIPTION

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Although the terms first, second, right, left, front, back, top, bottom, etc., may be used herein to describe various features, elements, components, regions, layers and/or sections, these features, elements, components, regions, layers and/or sections should not be limited by these terms. These terms are only used to distinguish one feature, element, component, region, layer, or section from another feature, element, component, region, layer, or section. Thus, a first feature, element, component, region, layer, or section discussed below could be termed a second feature, element, component, region, layer, or section without departing from the teachings of the disclosure herein.

Similarly, when a feature or element is being described in the present disclosure as "on" or "over" another feature or element, it is to be understood that the features or elements can either be directly contacting each other or have another feature or element between them, unless expressly stated to the contrary. Thus, these terms are simply describing the relative position of the features or elements to each other and do not necessarily mean "on top of" since the relative position above or below depends upon the orientation of the device to the viewer.

Embodiments of the subject matter of the disclosure are described herein with reference to schematic illustrations of embodiments that may be idealized. The drawings are not made necessarily to scale. Thus, not all embodiments within the scope of the drawings and these descriptions are made according to the apparent scale of the drawings with regard to relative dimensions in the drawings. As such, variations from the shapes and/or positions of features, elements, or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted, or simplified to facilitate explanation of the subject matter disclosed herein. Thus, the features, elements or components illustrated in the figures are schematic in nature and their shapes and/or positions are not intended to illustrate the precise configuration of the subject matter and are not necessarily intended to limit the scope of the subject matter disclosed herein unless it specifically stated otherwise herein.

Any dimensions expressed or implied in the drawings and these descriptions are provided for exemplary purposes. Thus, not all embodiments within the scope of the drawings and these descriptions are made according to such exemplary dimensions. It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

As used herein the terms "retractable" and "collapsible" and their variations are used interchangeably when describing the collapsible chassis of the multipurpose travel bags disclosed herein.

The present disclosure provides multipurpose travel bags, multipurpose travel bag systems, and related methods are provided herein. For example, in some embodiments, a multipurpose travel bag can include a top receptacle portion having a top wall, sidewalls, and an openable floor and a base having an open base cavity therein that faces upward. The multipurpose travel bag can include a collapsible chassis attached to the top receptacle portion and the base. The collapsible chassis can have sidewalls that are extendable and retractable between an extended position and a retracted position such that the collapsible chassis fits into the cavity of the base when the collapsible chassis is collapsed into the retracted position. When collapsed, the collapsible chassis can fit in the base cavity to form a smaller travel bag such that the collapsible chassis is in the retracted position. The top receptacle portion can be attached to the base to hold the top receptacle to the base to keep the collapsible chassis in a retracted position and the travel bag configured as a smaller travel bag. When desired by the user, the top receptacle portion can detach from the base so that the collapsible chassis can be extended to the extended position to form a larger travel bag. The floor within the top receptacle can be opened when the collapsible chassis is in the extended position to form an enlarged storage cavity. With the collapsible chassis is in the extended position, the travel bag can be converted from small travel luggage to a travel bag for carrying golf clubs and a golf bag. A golf bag with golf clubs therein can be placed in the enlarged storage cavity of the travel bag when configured as a larger travel bag so that the golf clubs and golf bag are safely stored inside for protection during travel.

Additionally, the multipurpose travel bag can comprise a travel bag system that is convertible between a smaller travel bag and a larger travel bag configured to carry a golf bag. The travel bag can include a top receptacle portion having a top wall, sidewalls, and an openable floor and a base having an open base cavity therein that faces upward. The multipurpose travel bag can include a collapsible chassis attached to the top receptacle portion and the base. The collapsible chassis can have sidewalls that can be extended and retracted between an extended position and a retracted position such that the collapsible chassis fits into the cavity of the base when the collapsible chassis is collapsed into the retracted position. When the floor within the top receptacle is opened and the collapsible chassis is in the extended position, an enlarged storage cavity is formed that is configured to hold a golf bag with golf clubs therein. The travel bag system can further comprise a stiffening rod that can be inserted into the enlarged cavity and is configured to extend within the enlarged storage cavity to separate the top receptacle portion and the base and extend the side walls of the collapsible chassis to provide space and protection for carrying a golf bag with golf clubs therein within the enlarged storage cavity.

Referring to FIGS. 1-13, a multipurpose travel bag, generally designated as 10, is provided. The multipurpose travel bag 10 allows a user to convert the travel bag 10 between a smaller travel bag 10A as shown in FIGS. 1-4A that can be a size to permit the smaller travel bag to be used as carry-on luggage for air travel and a larger travel bag 10B that is a size that permits the larger travel bag 10B to serve as a travel bag for a golf bag with golf clubs therein as shown in FIGS. 5-13. By having a travel bag 10 that has dual functionality to be used as both normal luggage 10A and a golf bag travel bag 10B, a user can get much more use from the travel bag 10 as compared to a travel bag bought solely for carrying a golf bag.

Figure 3:
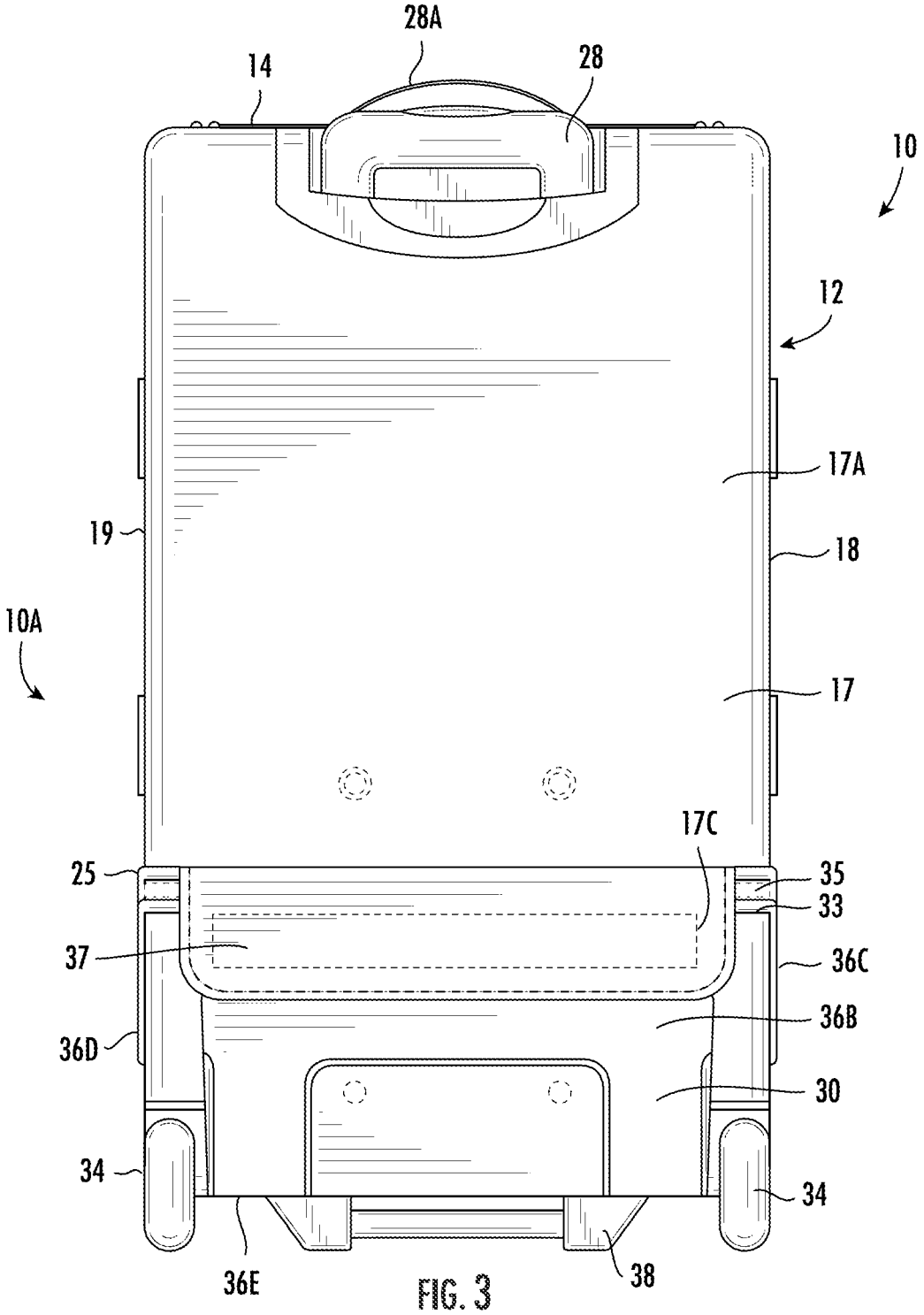
FIG. 3 illustrates a rear side plan view of the embodiment of the multipurpose travel bag that has been converted to a smaller travel bag according to FIG. 1.
Figure 4A:
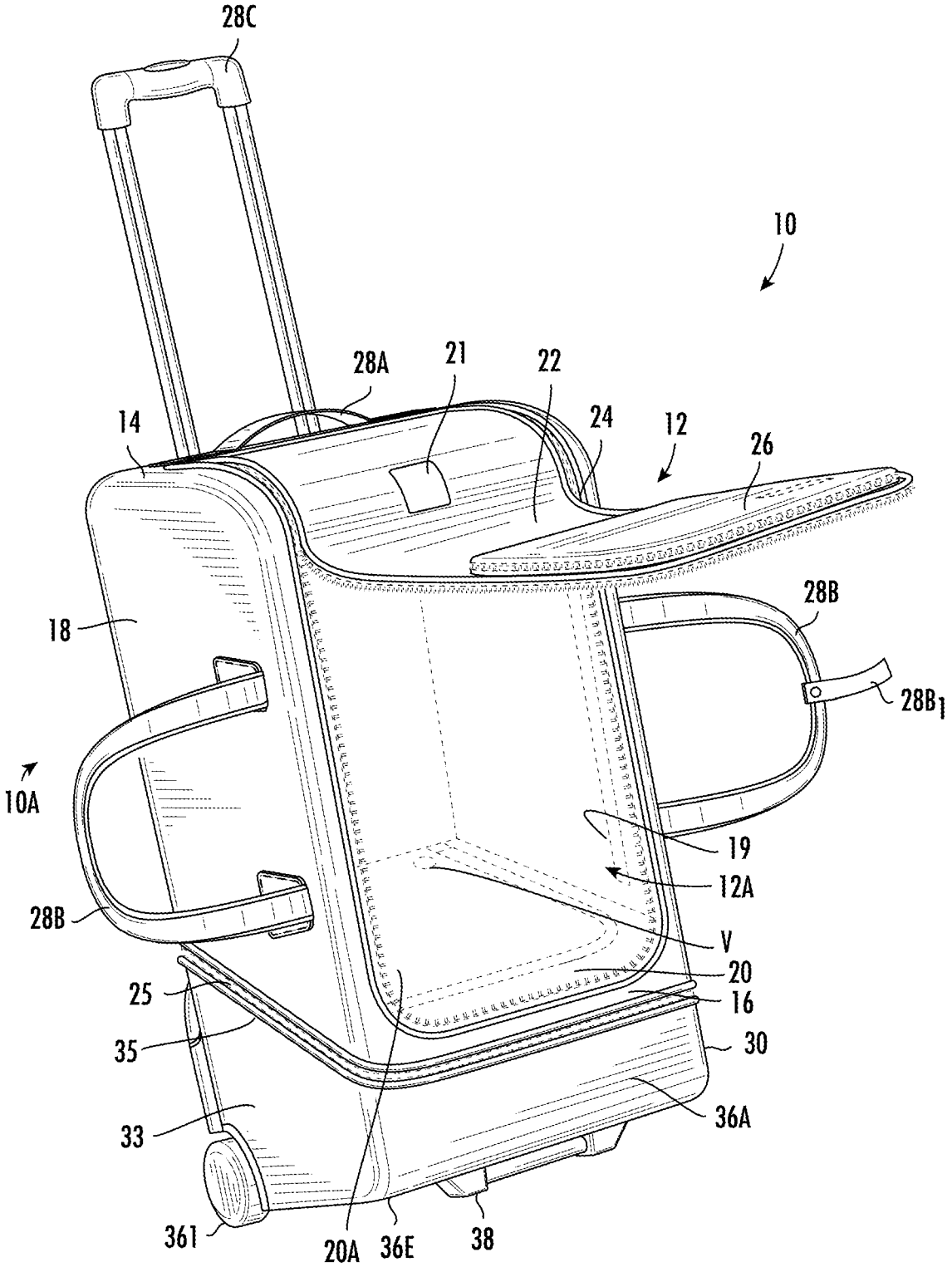
FIG. 4A illustrates a front left side perspective view of the embodiment of the multipurpose travel bag that has been converted to a smaller travel bag with an access panel partially opened and a pull handle in an extended position according to FIG. 1.
Figure 4B:
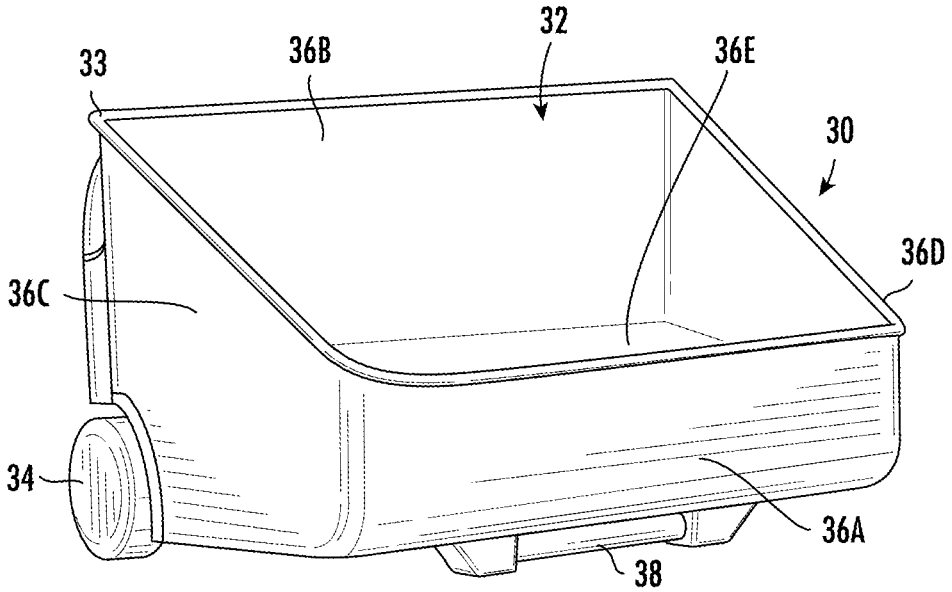
FIG. 4B illustrates a front left side perspective view of an embodiment of a base of the multipurpose travel bag according to FIG. 1.
Figure 4C:
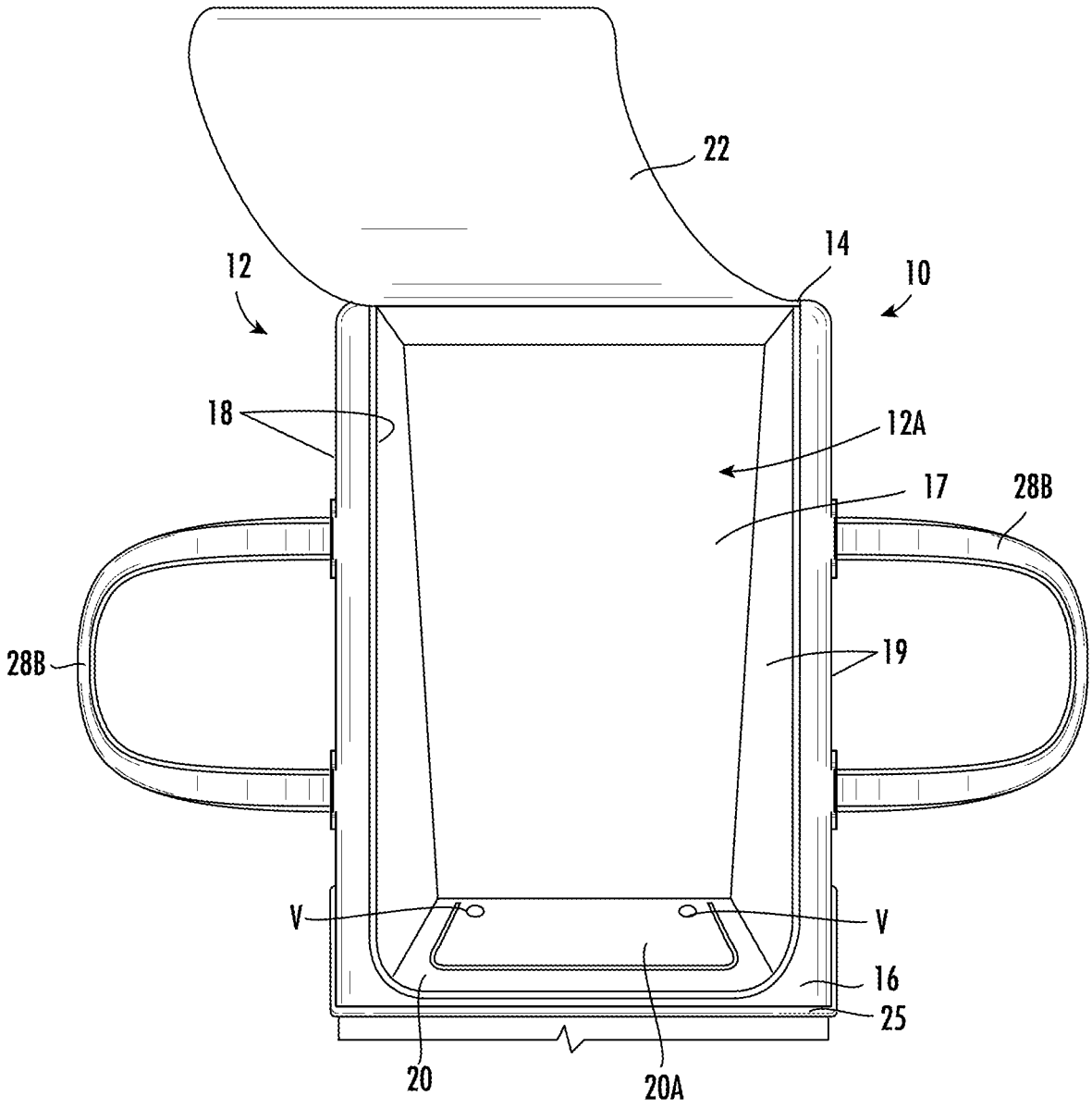
FIG. 4C illustrates a front side plan view of an embodiment of the multipurpose travel bag showing an embodiment of an interior receptacle cavity of a top receptacle portion of the multipurpose travel bag with a floor panel in a floor of the top receptacle portion in a closed position according to the present subject matter.
Figure 4D:
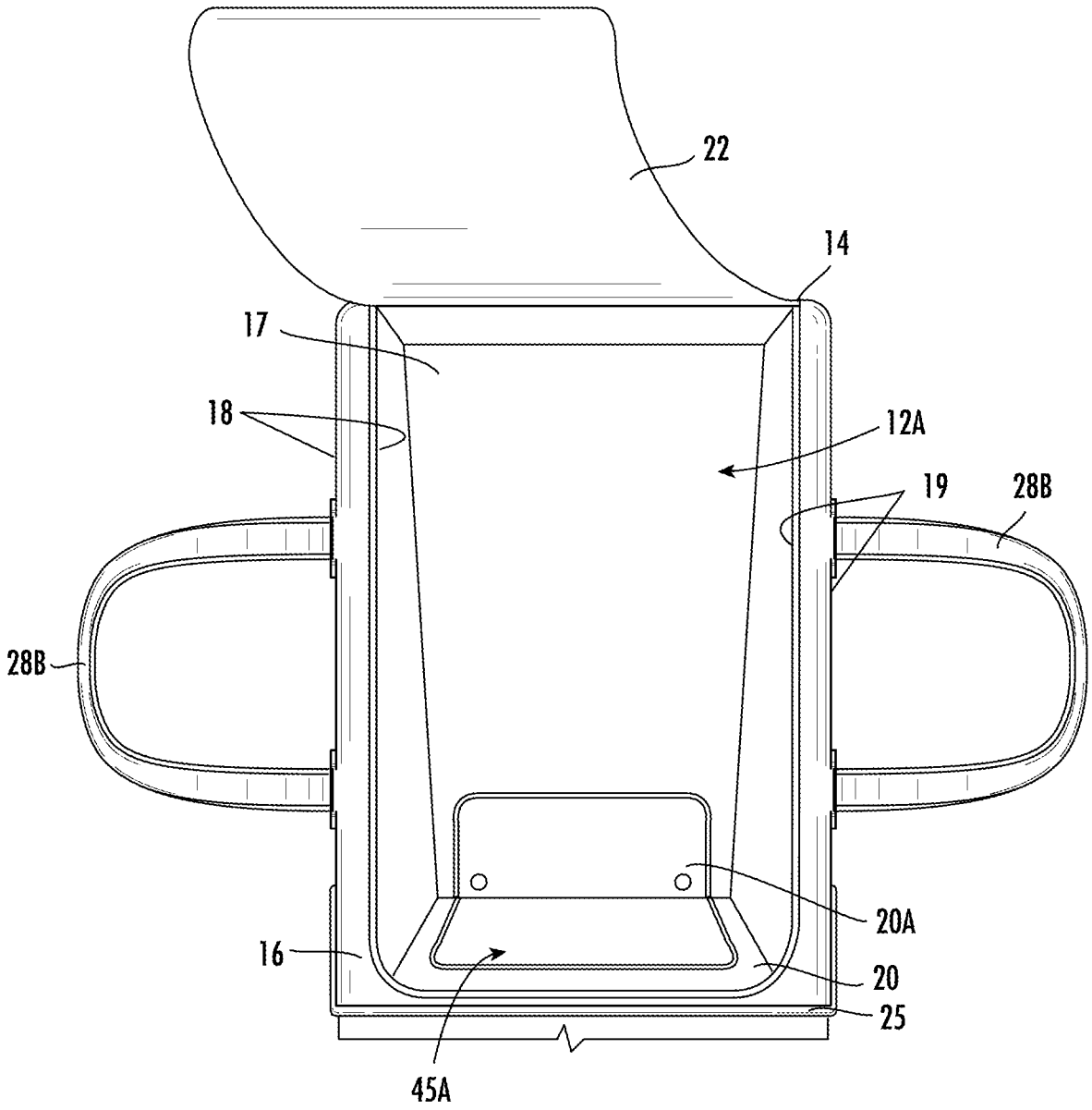
FIG. 4D illustrates a front side plan view of the embodiment of the multipurpose travel bag showing the interior receptacle cavity of the top receptacle portion of the multipurpose travel bag with the floor panel in the floor of the top receptacle portion according to FIG. 4C in an open position.
Figure 4E:
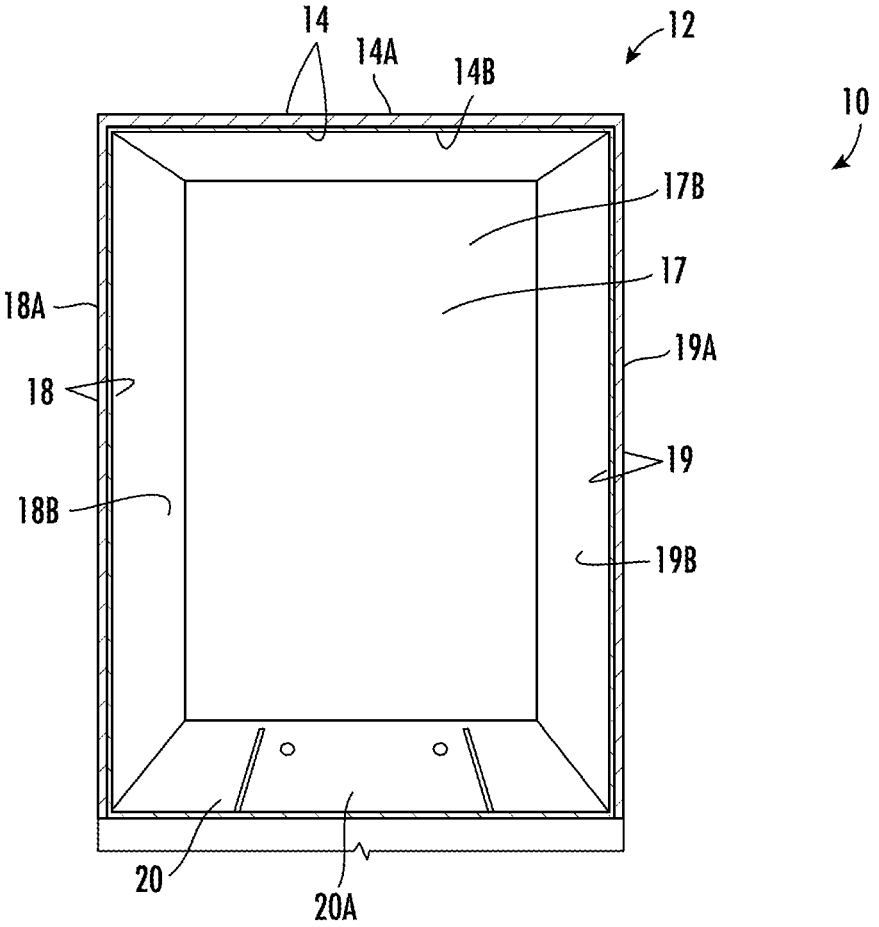
FIG. 4E illustrates a cross-sectional view of the embodiment of the top receptacle portion of the multipurpose travel bag showing the interior receptacle cavity of the top receptacle portion of the multipurpose travel bag according to FIG. 4C.
Figure 5:
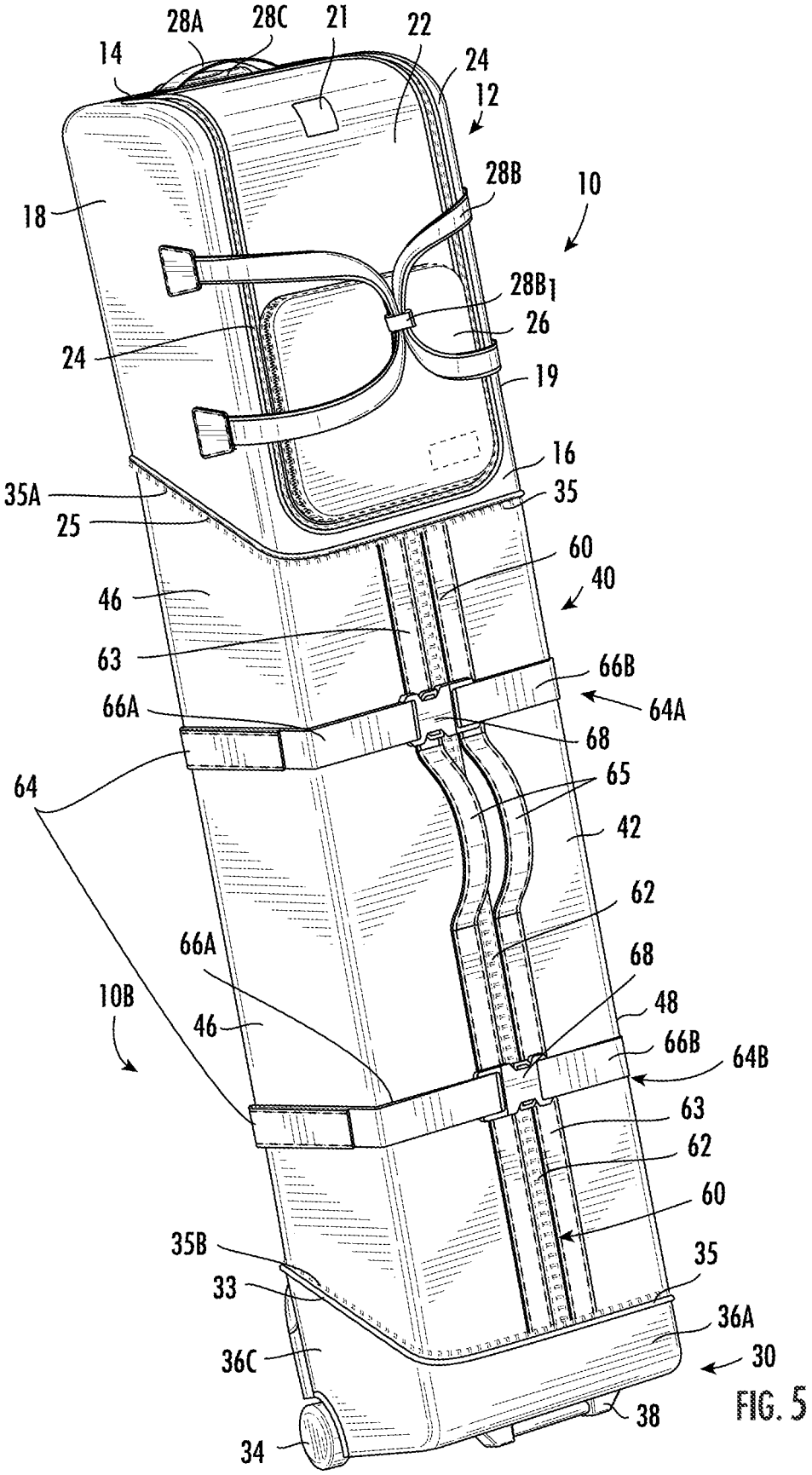
FIG. 5 illustrates a front left side perspective view of the embodiment of a multipurpose travel bag according to FIG. 1 that has been converted to a larger travel bag with a collapsible chassis in an extended position according to the present subject matter.

Referring to FIGS. 1-5, the travel bag 10 can comprise a top receptacle portion 12 having a top wall 14, sidewalls 16, 17, 18, and 19, and an openable floor 20. The travel bag 10 can also comprise a base 30 having an open base cavity 32 therein that faces upward as shown in FIG. 4B as well as a collapsible chassis 40 attached to the top receptacle portion 12 and the base 30 as shown in FIG. 5. The collapsible chassis 40 can have sidewalls 42, 44, 46, 48 that are extendable and retractable between an extended position as shown in the larger travel bag 10B and a retracted position as shown in the smaller travel bag 10A. When the collapsible chassis 40 is collapsed into the retracted position, the collapsible chassis 40 fits into the cavity 32 of the base 30. When the collapsible chassis 40 is extended into the extended position, the side walls 42, 44, 46, 48 of the collapsible chassis 40 are pulled out of the base cavity 32 so that they are exposed and extend between the top receptacle portion 12 and the base 30.

For example, as shown in FIGS. 1-4D, the top receptacle portion 12 of the travel bag 10 can be attached to the base 30 with the collapsible chassis (not shown in these figures) in the base cavity 32 in the base 30 to form the smaller travel bag 10A when the collapsible chassis 40 is in the retracted position. When the travel bag 10 is in this configuration of the smaller travel bag 10A, the smaller travel bag 10A can be used as a normal piece of luggage and can be a size and shape that meets the requirements for carry-on luggage for most airlines. The top receptacle portion 12 can have a receptacle cavity 12A in which items can be packed. In some embodiments, the receptacle cavity 12A can be defined by the top wall 14, the front sidewall 16, rear sidewall 17, and first and second sidewalls 18, and 19, as well an openable floor 20. Clothing, toiletries and/or other items can be packed into the receptacle cavity 12A on top of the floor 20 of the top receptacle portion 12.

To facility the packing, the top receptacle portion 12 can comprise an openable and closeable access panel, or flap, 22 that forms at least a portion of the front sidewall 16 of the top receptacle portion 12. The access panel 22 provides access to the receptacle cavity 12A of the top receptacle portion 12 when the openable floor is closed and to an enlarged storage cavity within the collapsible chassis is extended and the openable floor of the top receptacle portion is opened. In some embodiments as shown, the access panel 22 can extend up and include a portion of the top wall 14 of the top receptacle portion 12. The access panel 22 can be opened and closed by fasteners 24, such as zippers, buttons, snaps, hook and loop fasteners, or the like. In the embodiment shown in FIGS. 1-13, the fastener 24 can comprise a zipper system with one or two zipper slider pulls to permit the opening and the closing of the access panel 22. For example, with two slider pulls for the zipper 24, the access panel 22 can be partially opened from the bottom to allow loading of the receptacle cavity 12A without fully opening the access panel 22 through the top wall 14 of the top receptacle portion 12. With the access panel 22, the receptacle cavity 12A of the top receptacle portion 12 can be easily packed for a weekend getaway or for a week of travel when the travel bag 10 is used as a smaller travel bag 10A.

The top receptacle portion 12 can comprise other features such as handles, pockets, and/or compartments. For example, the top receptacle portion 12 can comprise one or more pockets 26 for providing additional storage space on the top receptacle portion 12 or within the receptacle cavity 12A. For instance, a pocket 26 can be provided on the access panel 22 and can be opened and closed by fasteners, such as zippers, buttons, snaps, hook and loop fasteners, or the like. Other pockets and compartments for storage and organization can also be provided.

As shown, in some embodiments, the top receptacle portion 12 can also comprise one or more handles. For example, the top receptacle portion 12 can include a top handle 28A that can be positioned on the top wall 14 to the travel bag 10. The top handle 28A to be picked up and carried from the top of the top receptacle portion 12 when the travel bag 10 is configured as a smaller travel bag 10A. In some embodiments, the top receptacle portion 12 can also comprise side handles 28B that can be secured to the first and second sidewalls 18, 19 that can be brought together to meet in front of the front sidewall 16 to allow the travel bag 10 when used as a smaller travel bag 10A to be picked up and carried from the side like a duffle bag. The side handles 28B can include a strap 28$B_1$ that permits the side handles 28B to be held together.

In some embodiments, the top receptacle portion 12 can additionally comprise an extendable and retractable pull handle 28C that can be extended from the rear wall 17 of the top receptacle portion 12 and can be retracted to be generally flush with the top wall 14. The base 30 can comprise wheels 34 attached to the base 30 to permit at least a portion of the travel bag 10 to roll. When the pull handle 28C is extended, the pull handle 28C and the wheels 34 on the base 30 can permit the travel bag 10 when used as a smaller travel bag 10A to be pulled as a user walks.

In some embodiments, the top receptacle portion 12 can be more rigid than the collapsible chassis 40 to provided added protection of the items that are packed or will reside within the receptacle cavity 12A. For example, in some embodiments, the top wall 14, the front sidewall 16, rear sidewall 17, and first and second sidewalls 18, and 19 of the top receptacle portion 12 can have extra padding or layers that can provide added protection for the receptacle cavity 12A. For example, the top wall 14, the front sidewall 16, rear sidewall 17, first sidewall 18, and second sidewall 19 as well as the access panel 22 of the top receptacle portion 12 can have two or more layers. These one or more extra layers can protective and/or cushion the golf clubs that extend into the top receptacle portion 12 of the travel bag 10 when it is extended.

As shown in FIG. 4E, in some embodiments, the top wall 14, the front sidewall 16, rear sidewall 17, first sidewall 18, and second sidewall 19 can have an inner layer and an outer layer. For example, the first side wall 18 can have an outer wall layer 18A an inner wall layer 18B, while the second sidewall 19 can have an outer wall layer 19A an inner wall layer 19B. Similarly, in some such embodiments, the top wall 14 can each have an outer wall layer 14A an inner wall layer 14B and the rear wall 17 can have an outer wall layer 17A an inner wall layer 17B as shown in FIGS. 3 and 4E. Additionally, the front sidewall 16 and the access panel 22 of the top receptacle portion 12 can have multiple layers. The inner and outer layers are separable layers can can comprise different materials. The different materials for the layer can have different purposes. For example, the respective inner layers 14B, 17B, 18B, 19B can be a fabric, padded fabric, laminate substrate, foam board, foam, plastic film board, or the like. The respective outer layers 14A, 17A, 18A, 19A can be a woven or knitted fabric or a rugged decorative fabric. In some embodiments, the respective outer layers 14A, 17A, 18A, 19A can be a hard case or a laminate substrate. In some embodiments, the collapsible chassis 40 can be a single layer can be easily collapsed into the base 30. For example, the collapsible chassis 40 can a fabric, such a woven nylon fabric. In some embodiments, the side walls 42, 44, 46, 48 of the collapsible chassis 40 can be a laminated fabric, such as a fabric with a coating or film applied to an interior face of the fabric that faces the cavity formed by the side walls 42, 44, 46, 48 of the collapsible chassis 40. One or more of materials of the separable layers of the top wall 14, the front sidewall 16, rear sidewall 17, first sidewall 18, and second sidewall 19 can be selected based on the protective qualities for cushioning and/or rigidity to provide more protection to the heads of the golf clubs GC that will reside in the top receptacle portion 12 as compared to the collapsible chassis 40 when a golf bag GB is within the travel bag 10.

The base 30 can have a front side wall 36A, a rear side wall 36B, first and second side walls 36C, 36D that can extend upward from a base bottom 36E as shown in FIG. 4B. The base 30 can have an open upper portion such that the base cavity 32 can reside within the front side wall 36A, rear side wall 36B, first and second side walls 36C, 36D with the bottom 36E forming a floor of the base cavity 32 with the cavity 32 being open upward. The base cavity 32 opens upward to be able to receive the collapsible chassis 40 therein when the travel bag 10 is converted to the smaller travel bag 10B. The wheels 34 of the base 30 can extend outward from the rear side wall 36B. In some embodiments, the wheels 34 can reside within the rear side wall 36B. In some embodiments, the wheels 34 can extend from the rear side wall 36B with one wheel 34 flush with the first side wall 36C and the other wheel 34 flush with the second side wall 36D. The base 30 can also comprise a stand 38 extending from an outer surface of the bottom 36E of the base 30. The stand 38 can provide a surface opposite the wheels 34 on which the base 30 and the smaller travel bag 10B can stand in an upright position. The stand 38 can also serve as an extra handle on the bottom 36E of the base 30 of the travel bag 10 to help carry and maneuver the travel bag 10 as needed.

When the top receptacle portion 12 is detached from the base 30, the collapsible chassis 40 can be extended to the extended position so that the travel bag 10 can be configured as a larger travel bag 10B as shown in FIGS. 4C and 4D and 5-13. The openable floor 20 of the top receptacle portion 20 can be opened so that the larger travel bag 10B comprises an enlarged storage cavity 45 when the collapsible chassis 40 is extended. In particular, as shown in FIGS. 4C and 4D, the floor 20 of the top receptacle portion 12 can comprise a floor panel 20A that is openable and closeable. The floor panel 20A can be comprise a separate component or can be created within a fabric floor substrate of the floor 20. In some embodiments as shown in FIGS. 4C and 4D, the fabric floor substrate of the floor 20 can be cut to form three sides of the floor panel 20A, the fourth side of the fabric floor panel 20A comprises a portion of the fabric substrate that operates as a hinge. Fasteners, such as zippers, hook and loop fasteners, or the like, can be secured the floor panel 20A and/or the portions of the floor 20 to permit the floor panel 20A to be opened or closed as shown in FIGS. 4C and 4D. When the collapsible chassis 40 is in the extended position, the floor panel 20A can be opened to form an opening 45A between the receptacle cavity 12A of the top receptacle portion 12 and a cavity formed between the extended pliable side walls 42, 44, 46, 48 of the collapsible chassis 40. Thereby, an enlarged storage cavity 45 can be formed between the receptacle cavity 12A of the top receptacle portion 12 and the cavity formed between the extended pliable side walls 42, 44, 46, 48 of the collapsible chassis 40 when the floor panel 20A is opened. The floor 20 and/or the fabric floor panel 20A can comprise a vent V that can permit airflow between the top receptacle cavity 12A and the cavity formed between the extended pliable side walls 42, 44, 46, 48 of the collapsible chassis 40 when the floor panel 20A is closed and the extended pliable side walls 42, 44, 46, 48 of the collapsible chassis 40 are being extended or retracted.

Figure 6:
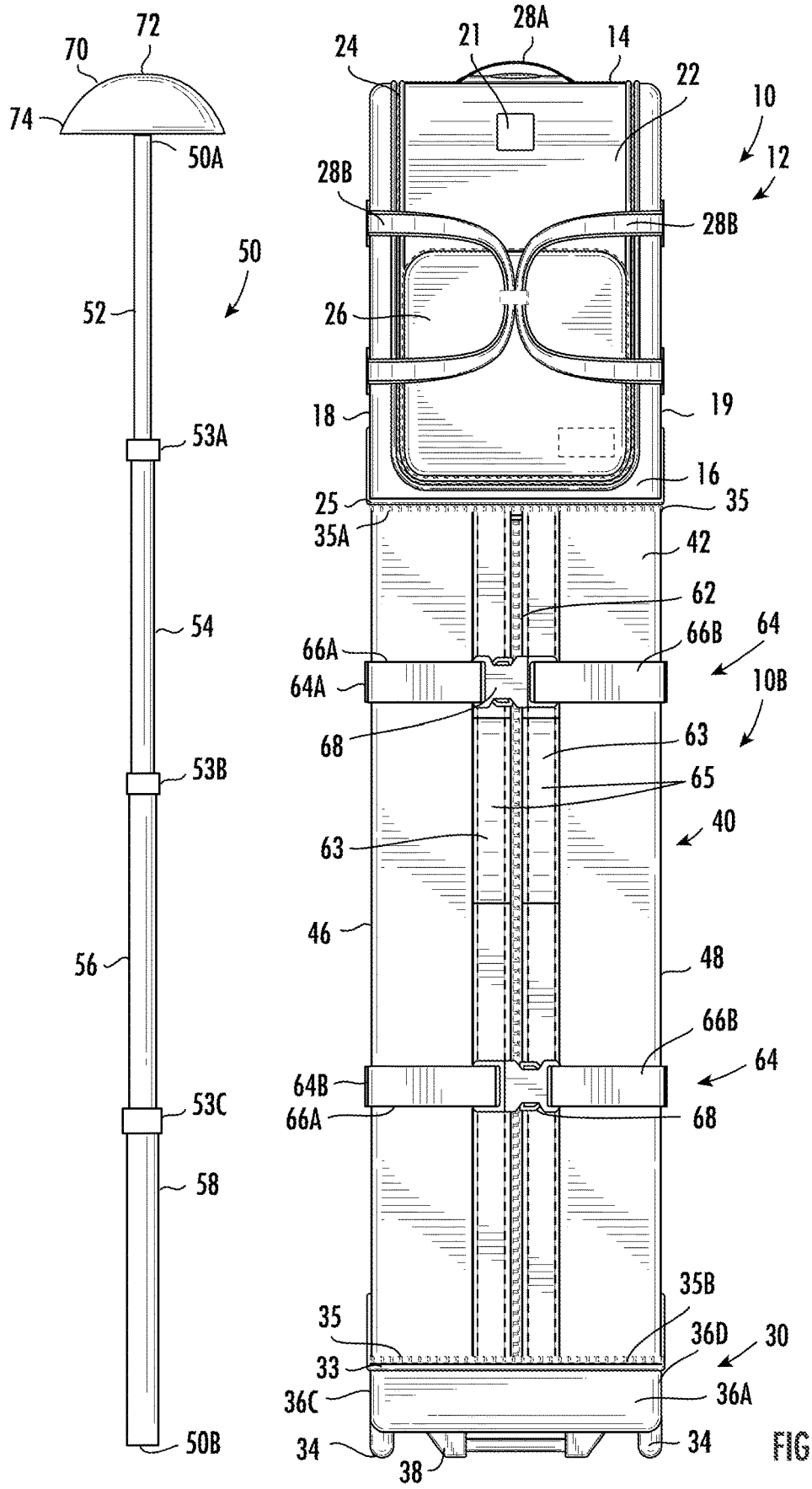
FIG. 6 illustrates a front side plan view of an embodiment of a multipurpose travel bag system that can be used to carry a golf bag with golf clubs according to the present subject matter.
Figure 11:
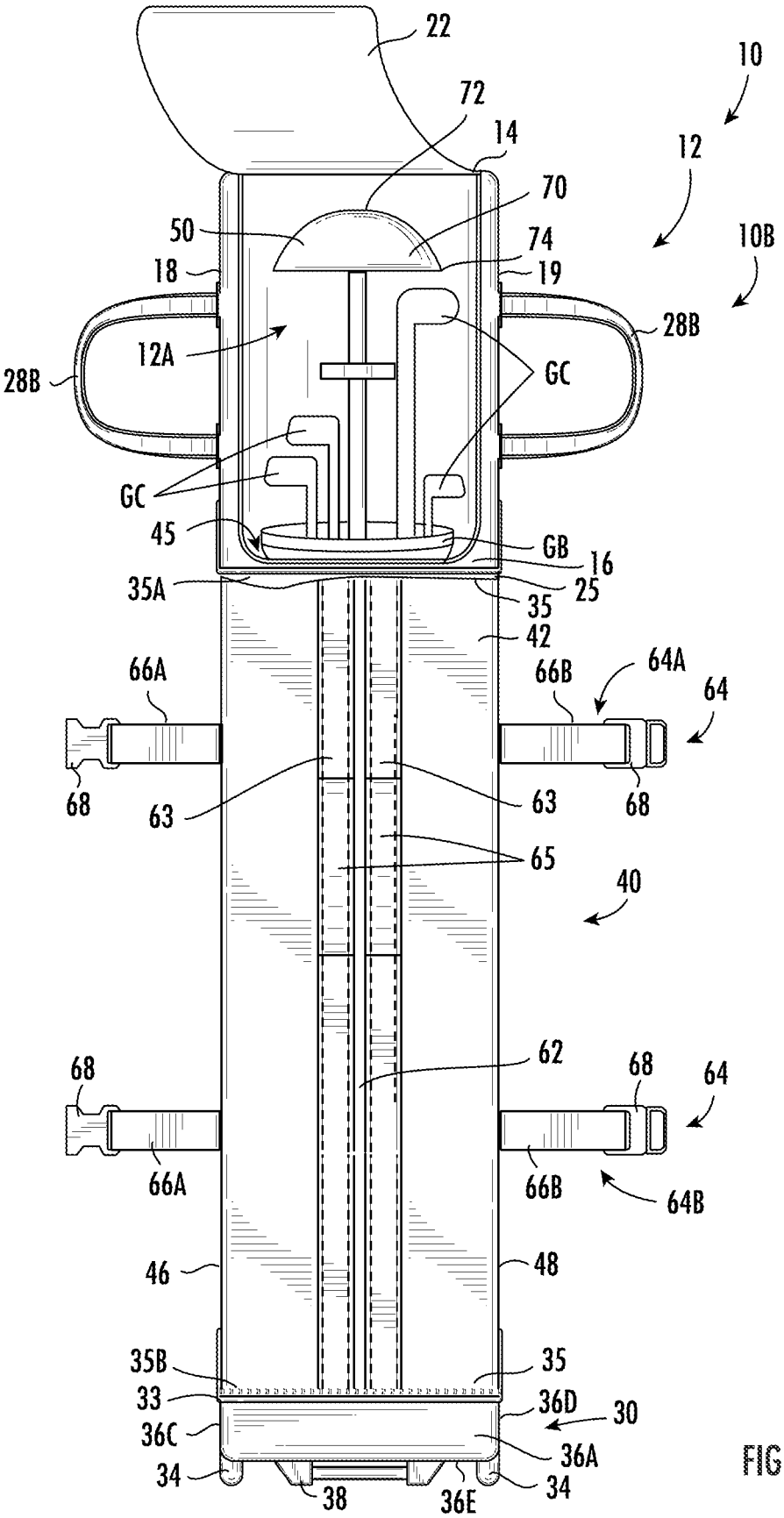
FIG. 11 illustrates a front plan view of the embodiment of the multipurpose travel bag system with the travel bag converted to the larger travel bag and packed with the golf bag according to FIG. 10 with the collapsible chassis opening closed and the access panel of the top receptacle portion opened.
Figure 12:
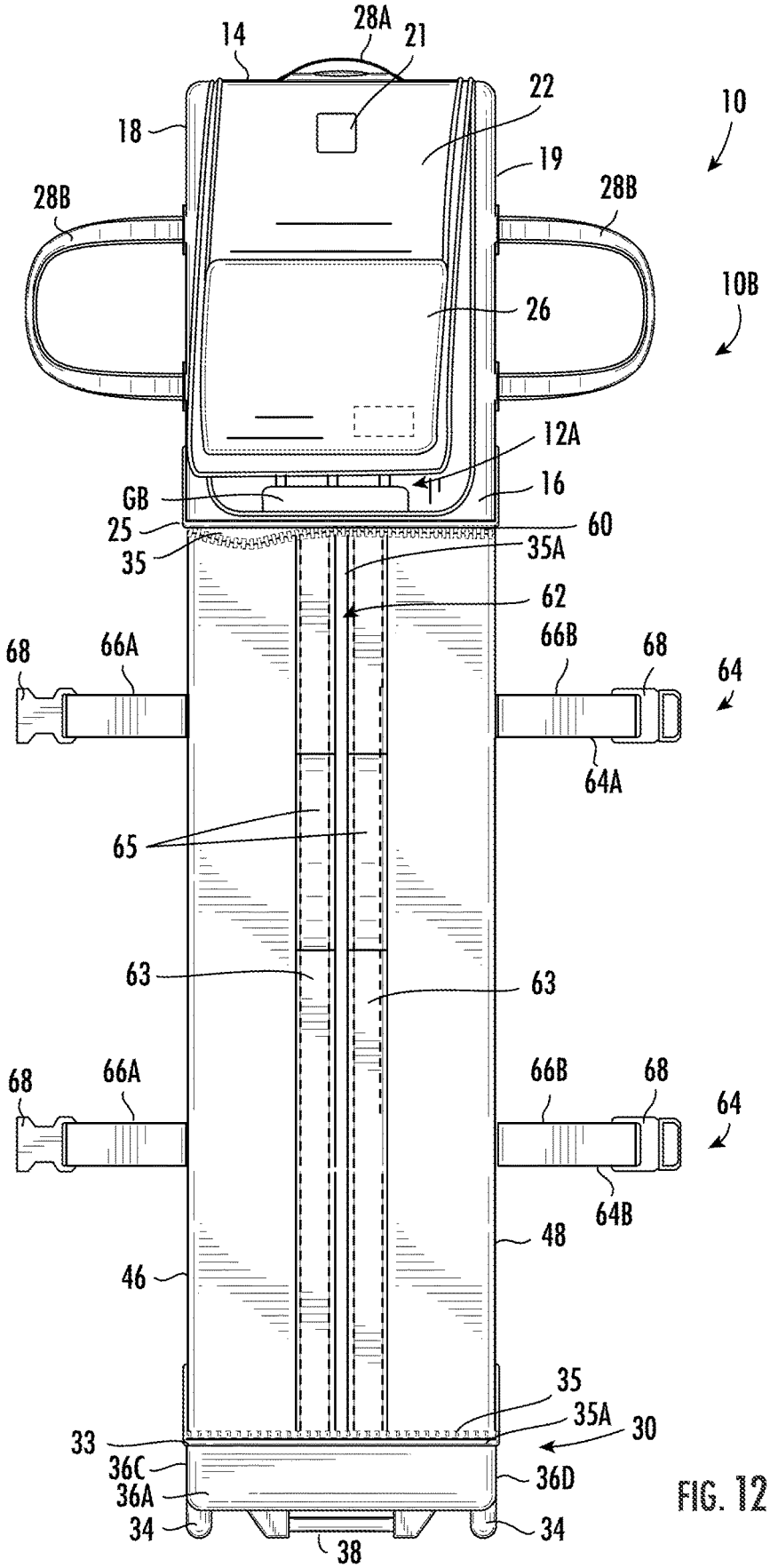
FIGS. 12 and 13 illustrates front plan views of the embodiment of the multipurpose travel bag system with the travel bag converted to the larger travel bag and packed with the golf bag according to FIG. 10 showing the access panel being closed.
Figure 13:
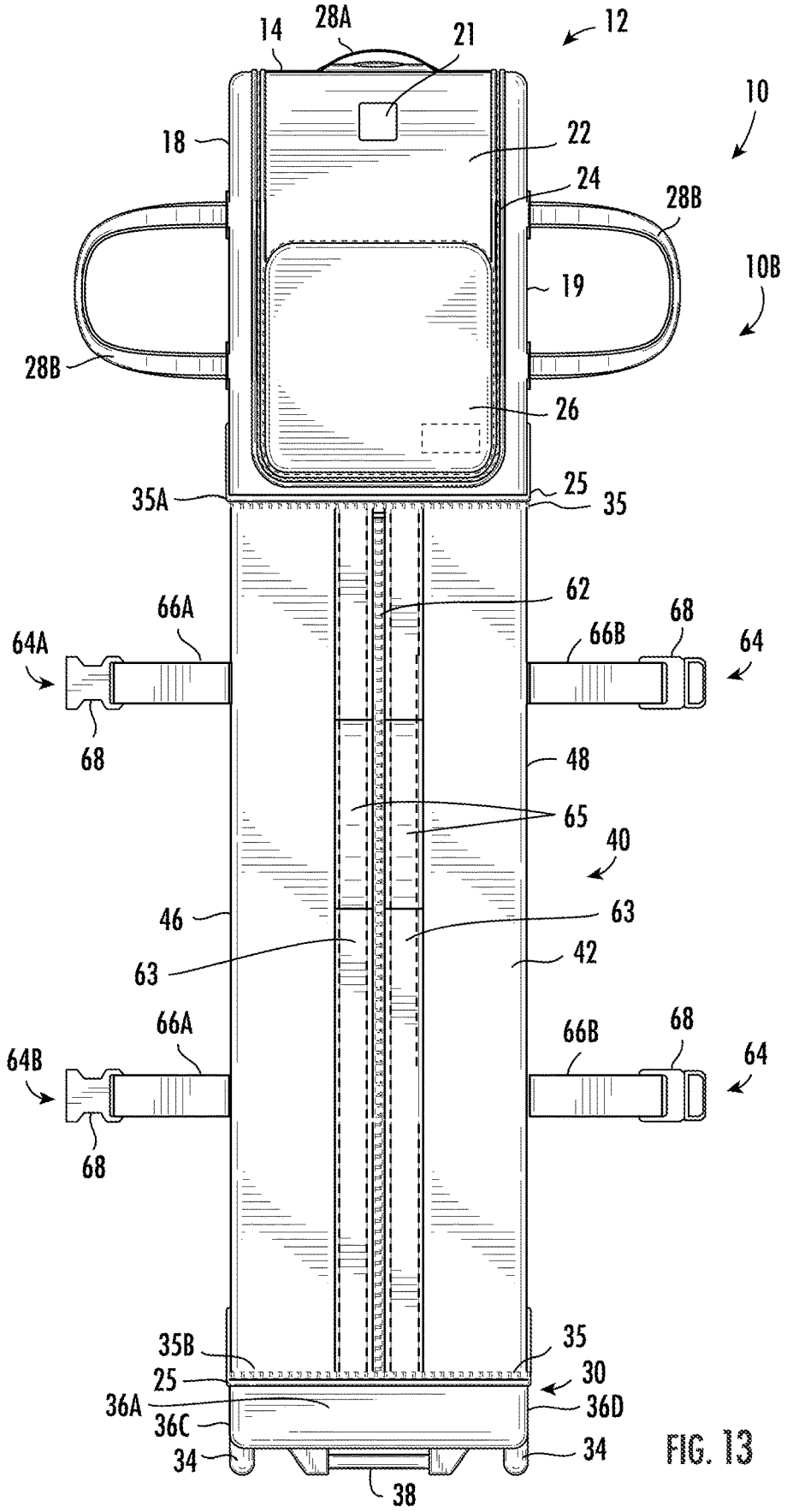

This enlarged storage cavity 45 is configured to be large enough to house a golf bag GB with golf clubs GC therein as shown in FIG. 11. A stiffening rod 50, which in some embodiments can be segmented for ease of storage as shown in FIG. 6, can be provided to be placed in the enlarged storage cavity 45 when the collapsible chassis 40 is extended to separate the receptacle portion and the base and extend the side walls 42, 44, 46, 48 of the collapsible chassis 40. The access panel 22 can provide access to a receptacle cavity 12A of the top receptacle portion 12 and the enlarged storage cavity 45 when the collapsible chassis 40 is extended and the openable floor 20 of the top receptacle portion 12 is opened.

The travel bag 10 can have a personalized marker plate 21 on it which can be on the chassis 40 or the top receptacle portion 12. For example, as shown in FIG. 1, in some embodiments, the top receptacle portion 12 can have a marker plate 21 on the access panel 22 in a visible position. The marker plate 21 can be detachable and can be interchangeable with other marker plates to personalize the travel bag 10 based on the golfer's preferences.

To facilitate the attachment and detachment of the top receptacle portion 12 and the base 30 to each other, the top receptacle portion 12 and the base 30 can comprise at least one fastener 35 configured to secure the top receptacle portion 12 to the base 30 when the collapsible chassis 40 is collapsed into the base cavity 32. For example, in some embodiments, the at least one fastener 35 can be zippers, buttons, snaps, hook and loop fasteners, or any combination thereof. For example, in some embodiments, as shown in FIG. 1-13, the at least one fastener 35 comprises a zipper that comprises a first zipper portion side 35A on a bottom perimeter edge 25 of the top receptacle portion 12 and a second zipper portion side 35B on a top perimeter edge 33 of the base 30. One zipper portion 35A or 35B can include a box and slider pull and the other zipper portion 35A or 35B can include a pin for engaging the box and slider pull to permit zipping of the zipper portions 35A, 35B for secure attachment. For example, the first zipper portion side 35A on the bottom perimeter edge 25 of the top receptacle portion 12 and a second zipper portion side 35B on a top perimeter edge 33 of the base 30 can be aligned with each other and engaged. They then can be zipped together to securely hold the top receptacle portion 12 and the base 30 together.

Figure 7:
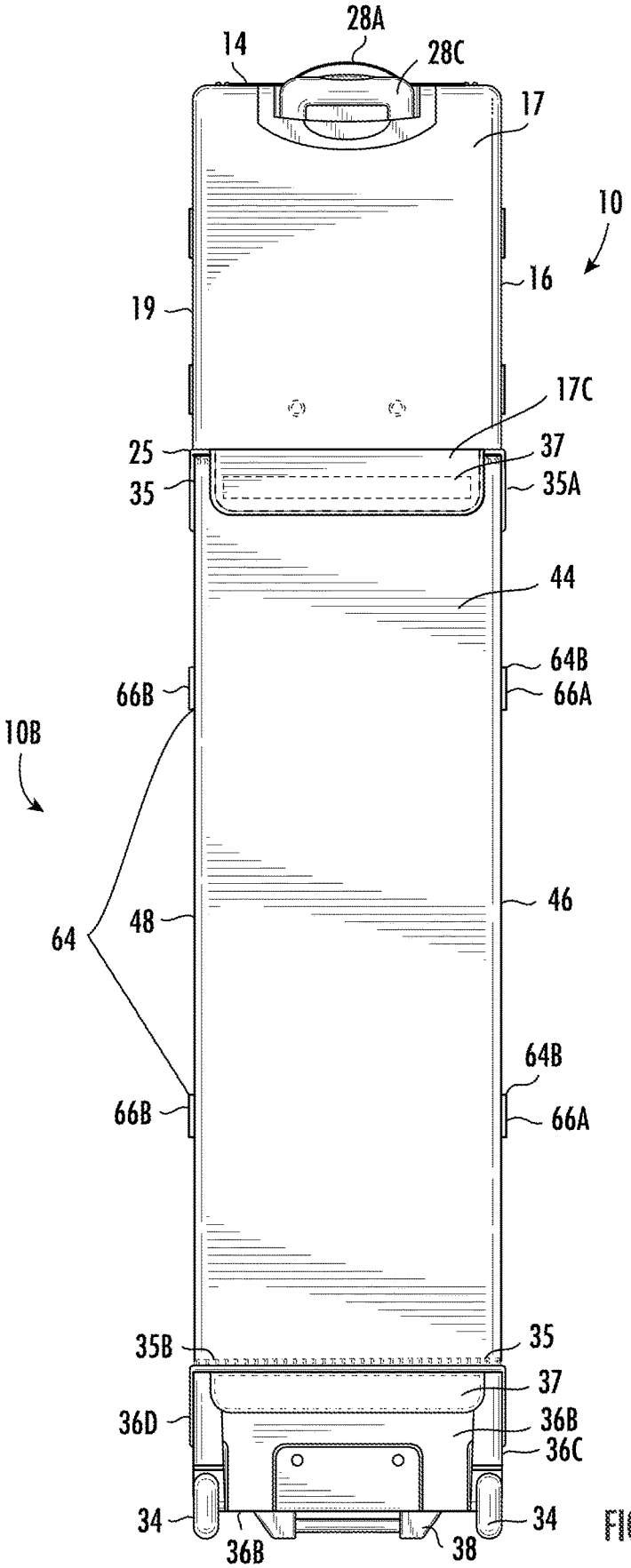
FIG. 7 illustrates a rear side plan view of the embodiment of the multipurpose travel bag that has been converted to a larger travel bag according to FIG. 5.
Figure 8:
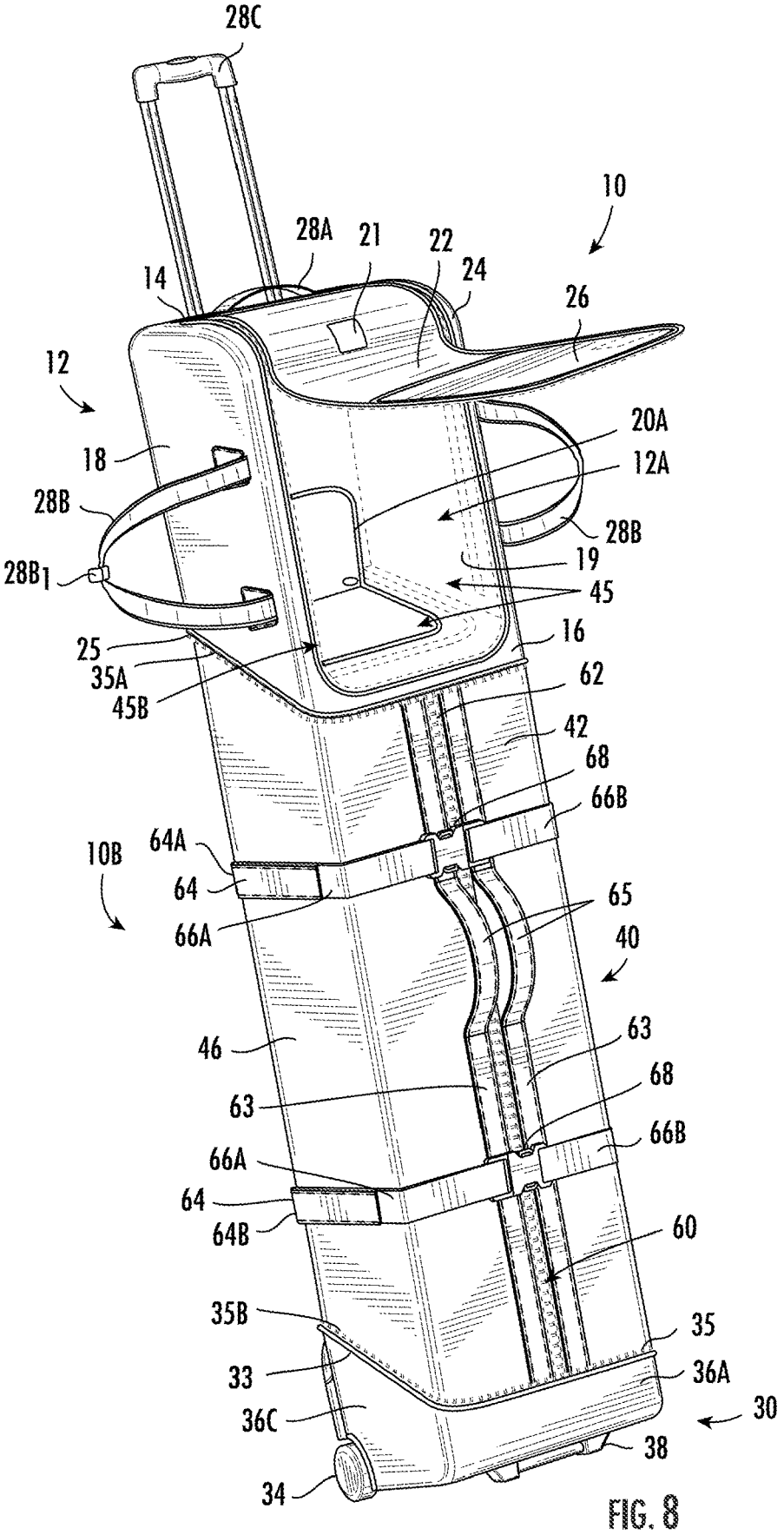
FIG. 8 illustrates a front right side perspective view of the embodiment of the multipurpose travel bag that has been converted to a larger travel bag according to FIG. 5 with an access panel partially opened, a pull handle in an extended position, and a floor panel in a floor a top receptacle portion in an open position to merge a top receptacle cavity with a collapsible chassis cavity to form an enlarged storage cavity within the larger travel bag.

Additionally, in some embodiments, the top receptacle portion 12 and the base 30 can also comprise another fastener 37. As shown in FIGS. 1-7, the fastener 35 can extend along the first side walls, 18, 36C, the front side walls 16, 36A and the second side walls 19, 36D of the respective top receptacle portion 12 and base 30. The fastener 35 can secure three sides of the top receptacle portion 12 and the base 30 together. The fastener 37 can comprise a hook and loop fastener on a rear portion of the travel bag 10. For example, a portion of a hook and loop fastener 37 can be connected to a flap 17C extending down from the rear side wall 17 of the top receptacle 12 and a portion of the hook and loop fastener 37 can be disposed on the rear side wall 36B of the base 30 as shown in FIGS. 3 and 7. When the first zipper portion side 35A and the second zipper portion side 35B are secured together holding the top receptacle portion 12 and the base 30 together, the portion of the hook and loop fastener 37 connected to the flap of the rear side wall 17 of the top receptacle portion 12 can engage the portion of the hook and loop fastener 37 connected to the rear side wall 36B of the base 30 to further hold the top receptacle portion 12 to the base 30 to convert the travel bag 10 to the smaller travel bag 10A. Additionally, the zipper portion sides 35A, 35B can be unzipped and the portions of the hook and loop fastener 37 can be released from each other to allow separation between the top receptacle portion 12 and the base 30 and the extension of the collapsible chassis 40 to the extended position.

As stated above, the collapsible chassis 40 can comprise a front wall 42, first side wall 44, a second side wall 46 opposite the first side wall 44, and a rear wall 48. The front wall 42 can have an opening 60 therein to help facilitate insertion of items into the enlarged cavity 45 or, if the floor 20 is closed, a cavity within the side walls 42, 44, 46, 48 within the collapsible chassis. The front wall 42 of the collapsible chassis 40 can have one or more fasteners 62 thereon for opening and closing the opening 60. The one or more fasteners 62 can be any one of a variety of different fasteners and can include, but are not limited to zippers, buttons, snaps, buckles, strap and buckles, hook and loop fasteners, or the like. The edge portions of the front wall 42 of the collapsible chassis 40 can have portions of the fasteners 62 thereon for opening and closing the opening 60. In some embodiments as shown, the opening 60 in the front side wall 42 can extend vertically between the top receptacle portion 12 and the base 30. The one or more fasteners 62 comprises a zipper secured to edges of the front side wall 42 forming the opening 60 to open and close the opening 60 in the front side wall 42 of the collapsible chassis 40.

To help further secure the collapsible chassis 40 and aid in relieving possible stress on the zipper 62 created by the weight of the items placed within the enlarged storage cavity, additional fasteners 64 can be secured to the side walls 42, 44, 46, 48 of the collapsible chassis 40. For example, in some embodiments, at least one set of straps 64 can be extended across the front side wall 42 of the chassis 40. For instance, at least one set of straps 64 can extend transverse to the opening 60 of the front side wall 42. For example, in some embodiments, the at least one set of straps 64 comprise two sets of straps 64A, 64B. In some embodiments, each set of straps 64A, 64B can comprise a first strap 66A that extends from the first side wall 46 and a second strap 66B that extends from the second side wall 48. The first and second straps 66A, 66B can have mating fasteners 68 that are engageable with each other along the front wall 42 of the collapsible chassis 40. The mating fasteners 68 can be any one of a variety of different fasteners and can include, but are not limited to zippers, buttons, snaps, buckles, strap and buckles, hook and loop fasteners, or the like. For example, the mating fasteners 68 can be buckles. When the buckles 68 are fastened, the straps 64A, 64B can be tightened to cinch the side walls 42, 46, 48 around the golf bag GB. This allows the golf bag GB to help provide further support to the side walls 42, 44, 46, 48. In this manner, in some embodiments, the straps 64A, 64B can aid in stiffening the side walls 42, 44, 46, 48 by using the rigidity of the golf bag GB placed within the enlarged cavity 45 within the side walls 42, 44, 46, 48.

The front side wall 42 of the chassis 40 can also have one or more handles 65 that can be strategically placed along the front side wall 42 of the chassis 40 so that, when the larger travel bag 10B has a golf bag with golf clubs within the enlarged storage cavity 45, the larger travel bag 10B is balanced when carried. In some embodiments not shown, each set of straps 64A, 64B can comprise a single strap have two ends that extends around the first, rear, and second side walls 46, 44, 48 with the ends having fasteners that engage each other in front of the front side wall 42. In some embodiments, as shown in FIGS. 6, 8, and 11-13, the handles 65 can be formed by reinforcement strips 63 that extend on either side of the one or more fasteners 62. For example, the reinforcement strips 63 that extend on either side of and parallel to the zipper 62, when a zipper is used as the one or more fasteners. The reinforcement strips 63 can run the length of the chassis and can aid in relieving stress placed on the zipper 62. Additionally, the reinforcement strips 63 can be used to help distribute and dissipate the forces placed on the zipper 62 and the chassis 40 when the travel bag 10 is carried by the handles 65.

Referring again to stiffening rod 50 that can be used in conjunction with the travel bag 10, the stiffening rod 50 can be configured to extend within the enlarged storage cavity 45 when the collapsible chassis 40 is extended to not only separate the receptacle portion 12 and the base 30, but also to extend the side walls of the collapsible chassis. The stiffening rod 50 can comprise a segmented stiffening rod to permit the stiffening rod 50 to become more compact for storage when not in use. In some embodiments (not shown), the stiffening rod 50 can comprise rod sections that can be attached together to form the fully extended stiffening rod 50 and detached from each other to break down the stiffening rod 50. In some embodiments (not shown), stiffening rod 50 can comprise a foldable stiffening rod having two or more detachable rod sections and a resilient shock cord that can extend through the two or more detachable rod sections to hold the detachable rod sections together when the sections are detached from each other and places tension on the two or more detachable rod sections when the rod sections are attached together.

Figure 9:
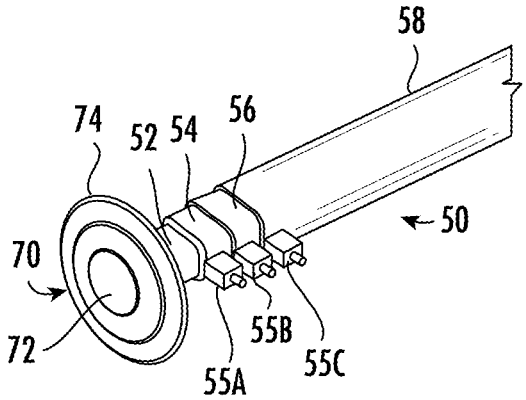
FIG. 9 illustrates a perspective view of an embodiment of a stiffening rod in a retracted position according to present subject matter that can be part of the multipurpose travel bag system according to FIG. 6.
Figure 10:
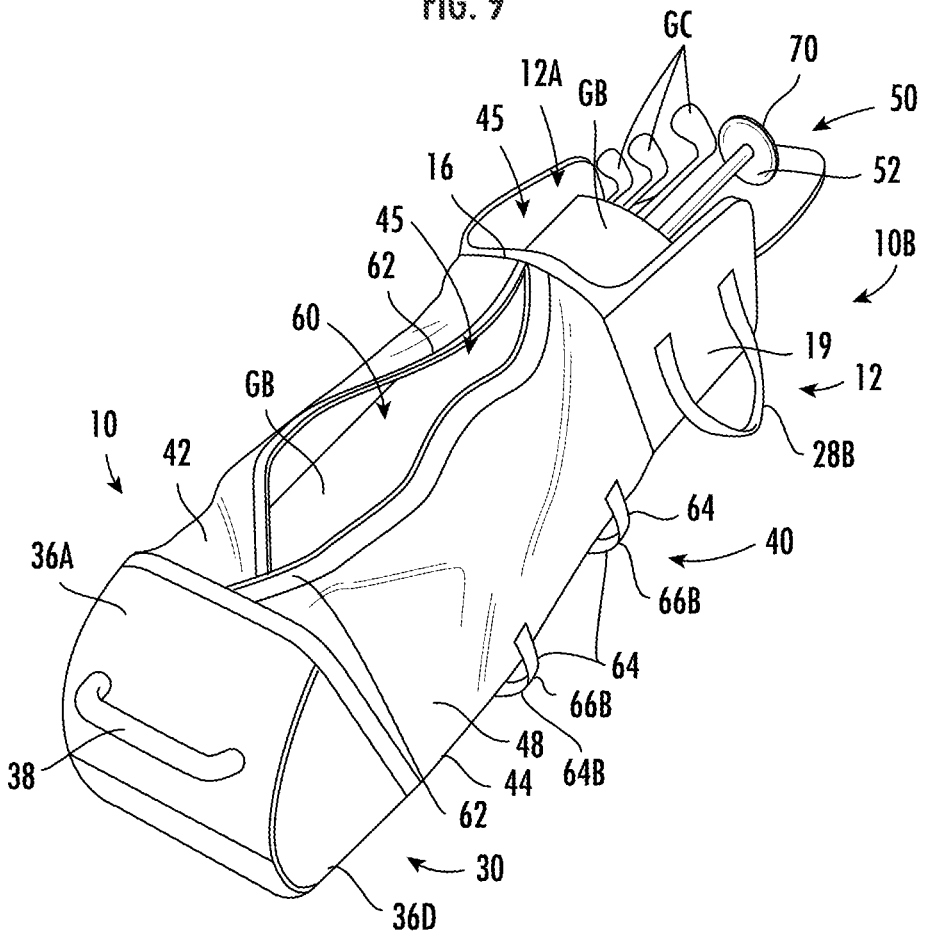
FIG. 10 illustrates a perspective view of the embodiment of the multipurpose travel bag system with the travel bag converted to a larger travel bag according to FIG. 6 being packed with a golf bag with golf clubs therein with a collapsible chassis and the access panel of the top receptacle portion opened.

In some embodiments as shown, the stiffening rod 50 can comprise two or more telescoping rod sections as shown in FIGS. 6 and 9. For example, the stiffening rod 50 can have first, second, third, and fourth telescoping rod sections 52, 54, 56, 58. The rod sections can be held in their extended positions using locks. As shown in FIG. 6, the stiffening rod 50 can have locks 535A, 53B, 53C, such as twisting lock devices, that can be tightened to lock the telescoping rod sections 52, 54, 56, 58 in an extended position and can be loosed to retract the telescoping rod sections 52, 54, 56, 58 into a retracted position. As shown in FIG. 9, the stiffening rod 50 can have locks 55A, 55B, 55C, such as locking pin devices, that can lock the telescoping rod sections 52, 54, 56, 58 in an extended position and can be released to retract the telescoping rod sections 52, 54, 56, 58 into a retracted position.

In some embodiments, the stiffening rod 50 can comprise a first end 50A, the second end 50B and a domed cap 70 disposed on the first end 50A. The domed cap 70 can have a rounded top 72 that extends down to a dome base 74. In some embodiments, the dome base 74 can have a circumference that is greater than the outer perimeter of the first end 50A of the stiffening rod 50. For example, the domed cap 70 can have a dome base 74 can have a diameter that provides protection for the heads of the golf clubs. The stiffening rod 50 can be insertable into a golf bag GB that is placed in the enlarged storage cavity 45 with domed cap 70 abutting against the top wall 14 of the top receptacle portion 12 to hold the enlarged storage cavity 45 to a size that can house and protect golf clubs GC within the golf bag GB. For storage purposed, the stiffening rod 50 can be sized in its retracted position to fit within the top receptacle cavity 12A of the top receptacle portion 12. In some embodiments, to aid in storage, the domed cap 70 can be removable from the end of the stiffening rod 50. For example, in some embodiments, the domed cap 70 can be twisted on and off a threaded end of the stiffening rod 50.

Thus, as shown in FIGS. 6 and 10-13, the travel bag 10 as disclosed herein can be a multipurpose travel bag system that is convertible between a smaller travel bag 10A and a larger travel bag 10B configured to carry a golf bag. The travel bag 10 can comprise a top receptacle portion 12 having a top wall 14, sidewalls 16, 17, 18, 19, and an openable floor 20 and a base 30 having an open base cavity 32 therein that faces upward as described above. The travel bag 10 can comprise a collapsible chassis 40 attached to the top receptacle portion 12 and the base 30. The collapsible chassis 40 can have sidewalls 42, 44, 46, 48 that are extendable and retractable between an extended position and a retracted position such that the collapsible chassis 40 fits into the cavity 32 of the base 30 when the collapsible chassis 40 is collapsed into the retracted position. The top receptacle portion 12 can be attached to the base 30 when the collapsible chassis 40 is in the base cavity 32 to form a smaller travel bag 10A when the collapsible chassis 40 is in the retracted position. Additionally, the top receptacle portion 12 can be detached from the base 30 so that the collapsible chassis 40 is extendable to the extended position to form a larger travel bag 10B. As described above, the floor 20 within the top receptacle portion 12 can be opened when the collapsible chassis 40 is in the extended position to form an enlarged storage cavity 45 configured to hold a golf bag with golf clubs therein. The travel bag system can further comprise a stiffening rod 50 configured to extend within the enlarged storage cavity 45 to separate the top receptacle portion 12 and the base 30 and extend the side walls 42, 44, 46, 48 of the collapsible chassis 40 to provide space and protection for carrying a golf bag with golf clubs therein within the enlarged storage cavity 45.

Further, methods of converting a multipurpose travel bag between a smaller travel bag and a larger travel bag with an enlarged storage cavity have been provided. For example, in some embodiments, a method of converting a multipurpose travel bag between a smaller travel bag and a larger travel bag can comprise providing a convertible multipurpose travel bag. The travel bag can comprise a top receptacle portion having a top wall, sidewalls, and an openable floor and a base having an open base cavity therein that faces upward. The travel bag can also comprise a collapsible chassis attached to the top receptacle portion and the base. The collapsible chassis can have sidewalls that are extendable and collapsible between an extended position and a retracted position. When the user wants to convert the travel bag to a smaller travel bag, the method can comprise collapsing the side walls of the collapsible chassis into the cavity of the base into the retracted position. The method can also comprise attaching the top receptacle portion to the base of the travel bag to form a smaller travel bag. For example, for different embodiments, the top receptacle portion can be attached to the base in different ways, including using different fasteners as described above. In some embodiments, the size of the smaller travel bag to which the travel bag has been converted can be a size and shape that permits the smaller travel bag to meet the requirements for a carry-on bag for at least some commercial airlines.

When the user needs a larger travel bag that can include an enlarged storage cavity, the method can comprise detaching the top receptacle portion from the base. The step of detachment depends on the method of attachment of the top receptacle portion from the base of the travel bag. For example, the top receptacle portion can be detached from the base can be unfastened in different ways depending on the fasteners used as described above. The method can then comprise extending the collapsible chassis to the extended position to form a larger travel bag. The front side wall of the collapsible chassis can have an opening therein for providing access to a cavity formed between the extended side walls of the collapsible chassis. The collapsible chassis can have one or more fasteners thereon for opening and closing the opening in the front wall. The one or more fasteners can be any one of a variety of different fasteners and can include, but are not limited to zippers, buttons, snaps, hook and loop fasteners, or the like. The receptacle cavity in the top receptacle and the cavity formed between the side walls of the collapsible chassis can remain separated to provide two storage cavities or can be joined to form an enlarged storage cavity. For example, the method can comprise opening the floor within the top receptacle portion to form an enlarged storage cavity which can be configured to hold a golf bag with golf clubs therein. Further, the larger travel bag is being used for carrying a golf bag and golf clubs, the method can comprise inserting a stiffening rod into the enlarged storage cavity to separate the receptacle portion and the base and extend the side walls of the collapsible chassis to hold the enlarged storage cavity to a size that can house and protect golf clubs within the golf bag.

Additionally, methods of construction of a multipurpose travel bag are provided herein. For example, a method of construction of a multipurpose travel bag can comprise providing a top receptacle portion having a top wall, sidewalls, and an openable floor and a base having an open base cavity therein that faces upward. The method can comprise forming a collapsible chassis between the top receptacle portion and the base. For example, the collapsible chassis can comprise pliable side walls that can be connected to a bottom portion of the top receptacle portion and to an upper portion of the base with an opening formed in a front side wall of the pliable side walls. The pliable side walls can comprise a drapeable fabric so that the pliable side walls can be collapsed into a retracted position such that the collapsible chassis fits into the cavity of the base. The top receptacle portion and the base can have fastener portions or fastener members secured to them so that the top receptacle portion can be attached to the base to form a smaller travel bag when the collapsible chassis is in the retracted position in the base cavity. Further, the top receptacle portion can be detached from the base so that the collapsible chassis is extendable to the extended position to form a larger travel bag. The method can also comprise creating an opening in the floor of the top receptacle portion that can be closed with a floor panel. In some embodiments, the floor panel can be created within a fabric floor substrate and fasteners can be secured the floor panel and/or the portions of the floor substrate to permit the floor panel to be opened or closed. When the collapsible chassis is in the extended position, an enlarged storage cavity can be formed between the receptacle cavity of the top receptacle portion and a cavity formed between the extended pliable side walls when the floor panel is opened.

The pliable side walls can be a lightweight more flexibility substrate than the top receptacle portion and the base. The pliable side walls can have a height such that the pliable side walls do not extend past a height of a golf bag placed within the enlarged storage cavity when the collapsible chassis is in the extended position and the pliable side walls are extended. In such embodiments, golf clubs extending out of a top portion of the golf bag reside within the top receptacle portion of the travel bag that is more rigid and, in some embodiments, provide more padding, than the pliable side walls of the collapsible chassis to provide more protection to the golf clubs and particularly, the heads of the golf clubs.

Particular embodiments and features have been described with reference to the drawings. It is to be understood that these descriptions are not limited to any single embodiment or any particular set of features, and that similar embodiments and features may arise, or modifications and additions may be made without departing from the scope of these descriptions and the spirit of the appended claims.

What is claimed is:

1. A multipurpose travel bag that is convertible between a larger travel bag configured to carry a golf bag with golf clubs therein and a smaller travel bag, the multipurpose travel bag comprising:

a top receptacle portion having a top wall, sidewalls, and an openable floor configured to be opened during use as the larger travel bag to provide access into the top receptacle, the top wall and the side walls each comprise multiple, separable layers;

a base having an open base cavity therein that faces upward; and a collapsible chassis attached to the top receptacle portion and the base, the collapsible chassis having a front side wall, a first side wall, a second side wall opposite the first side wall, and a rear side wall, such that the collapsible chassis is extendable and retractable between an extended position and a retracted position such that the collapsible chassis fits into the cavity of the base when the collapsible chassis is collapsed into the retracted position;

the front side wall, the rear side wall, the first side wall, and the second side wall of the collapsible chassis each comprising a single layer and a height that does not extend past a height of a golf bag to be placed within the travel bag when the collapsible chassis is in the extended position and the openable floor of the top receptacle portion being opened, the front side wall of the collapsible chassis having an opening therein that extends vertically between the top receptacle portion and the base with handles attached to the single layered front side wall on either side of the opening in the single layered front side wall and a zipper secured to the front side wall at edges of the opening in the single layer front side wall that extends between the handles on the front side wall to open and close the opening in the front side wall of the collapsible chassis; and the top receptacle portion being attachable to the base with the collapsible chassis in the base cavity to form a smaller travel bag when the collapsible chassis is in the retracted position and the top receptacle portion being detachable from the base so that the collapsible chassis is extendable to the extended position to form a larger travel bag with the openable floor in the top receptacle open during use as the larger travel bag so that when the golf bag with clubs therein is placed in the larger travel bag, the golf bag resides in the collapsible chassis with the single layered front side wall, rear side wall, first side wall, and second side wall and heads of the clubs reside in the top receptacle portion with multiple, separable layered top wall and side walls.

2. The multipurpose travel bag according to claim 1, wherein the floor within the top receptacle is opened when the collapsible chassis is in the extended position to form an enlarged storage cavity.

3. The multipurpose travel bag according to claim 1, further comprising an openable and closeable access panel that forms at least a portion of a front sidewall of the sidewalls of the top receptacle portion, the access panel providing access to a receptacle cavity within the top receptacle portion with the openable floor is closed and to an enlarged storage cavity within the collapsible chassis is extended and the openable floor of the top receptacle portion is opened.

4. The multipurpose travel bag according to claim 3, wherein the openable and closeable panel also forms a portion of the top wall of the top receptacle portion.

5. The multipurpose travel bag according to claim 1, further comprising at least one set of straps that extends transverse to the opening of the front side wall, each set of straps comprising a first strap that extends from the first side wall and a second strap that extends from the second side wall, the first and second straps having mating fasteners that are engageable with each other along the front side wall of the collapsible chassis.

6. The multipurpose travel bag according to claim 1, wherein the top receptacle portion and the base has a zipper that can be used to secure the top receptacle portion to the base, the zipper comprising a first zipper portion side on a bottom perimeter edge of the top receptacle portion and a second zipper portion side on a top perimeter edge of the base that are alignable to engage each other and zip together.

7. The multipurpose travel bag according to claim 1, further comprising a flap that extends downward from the rear side wall of the top receptacle having fasteners thereon that are configured to engage fasteners disposed on the rear side wall of the base to further hold the top receptacle to the base when the multipurpose travel bag is converted to the smaller travel bag.

8. The multipurpose travel bag according to claim 1, wherein the top receptacle portion further comprises an openable and closeable access panel, the access panel forms an opening in the top receptacle when opened that does not align with the opening in front sidewall of the collapsible chassis.

9. The multipurpose travel bag according to claim 1, further comprising at least one set of straps that extends transverse to the opening of the single layer front side wall, the at least one set of straps having mating fasteners that are engageable with each other along the single layer front side wall of the collapsible chassis to aid in stiffening the single layer side walls in conjunction with a rigidity of a golf bag placed within the collapsible chassis.

10. A multipurpose travel bag system that is convertible between a smaller travel bag and a larger travel bag configured to carry a golf bag comprising:

a travel bag configured to be convertible between a larger travel bag and a smaller travel bag comprising:

a top receptacle portion having a top wall, sidewalls, and an openable floor configured to be opened during use as the larger travel bag to provide access into the top receptacle, the top wall and the side walls each comprise multiple, separable layers;

a base having an open base cavity therein that faces upward; and a collapsible chassis attached to the top receptacle portion and the base, the collapsible chassis having a front side wall, a first side wall, a second side wall opposite the first side wall, and a rear side wall, such that the collapsible chassis is extendable and retractable between an extended position and a retracted position such that the collapsible chassis fits into the cavity of the base when the collapsible chassis is collapsed into the retracted position;

the front side wall, the rear side wall, the first side wall, and the second side wall of the collapsible chassis each comprising a single layer and a height that does not extend past a height of a golf bag to be placed within the travel bag when the collapsible chassis is in the extended position and the openable floor of the top receptacle portion being opened, the front side wall of the collapsible chassis having an opening therein that extends vertically between the top receptacle portion and the base with handles attached to the single layered front side wall on either side of the opening in the single layered front side wall and a zipper secured to the front side wall at edges of the opening in the single layer front side wall to open and close the opening in the front side wall of the collapsible chassis; and the top receptacle portion being attachable to the base with the collapsible chassis in the base cavity to form a smaller travel bag when the collapsible chassis is in the retracted position in the base cavity and the top receptacle portion being detachable from the base so that the collapsible chassis is extendable to the extended position to form a larger travel bag, the floor within the top receptacle is opened when the collapsible chassis is in the extended position to form an enlarged storage cavity configured to hold golf bag with golf clubs therein, so that, when the golf bag with clubs therein is placed in the larger travel bag, the golf bag resides in the collapsible chassis with the single layered front side wall, rear side wall, first side wall, and second side wall and heads of the clubs reside in the top receptacle portion with multiple, separable layered top wall and side walls; and a stiffening rod configured to extend within the enlarged storage cavity to separate the receptacle portion and the base and extend the side walls of the collapsible chassis to provide space and protection for carrying the golf bag with golf clubs therein within the enlarged storage cavity.

11. The multipurpose travel bag system according to claim 10, further comprising an openable and closeable access panel that forms at least a portion of a front sidewall of the sidewalls of the top receptacle portion, the access panel providing access to a receptacle cavity within the top receptacle portion with the openable floor is closed and to an enlarged storage cavity within the collapsible chassis is extended and the openable floor of the top receptacle portion is opened.

12. The multipurpose travel bag system according to claim 10, further comprising at least one set of straps that extends transverse to the opening of the front wall, each set of straps comprising a first strap that extends from the first side wall and a second strap that extends from the second side wall, the first and second straps having mating fasteners that are engageable with each other along the front side wall of the collapsible chassis.

13. The multipurpose travel bag system according to claim 10, wherein the top receptacle portion and the base has a zipper configured to secure the top receptacle portion to the base when the collapsible chassis is collapsed into the base cavity and the zipper comprises a first zipper portion side on a bottom perimeter edge of the top receptacle portion and a second zipper portion side on a top perimeter edge of the base that are alignable to engage each other and zip together.

14. The multipurpose travel bag system according to claim 10, wherein the stiffening rod comprises a segmented stiffening rod comprising two or more telescoping rod sections.

15. The multipurpose travel bag according to claim 14, wherein the stiffening rod comprises a first end, the second end and a domed cap disposed on the first end that has a rounded top that extends down to a dome base, wherein the dome base has a circumference that is greater than the outer perimeter of the first end of the stiffening rod.

16. The multipurpose travel bag according to claim 15, wherein the stiffening rod is insertable into a golf bag that is placed in the enlarged storage cavity with the domed cap abutting against the top wall of the top receptacle portion to hold the enlarged storage cavity to a size that can house and protect golf clubs within the golf bag.

17. A method of converting a multipurpose travel bag between a smaller travel bag and a larger travel bag with an enlarged storage cavity, the method comprising:

providing a travel bag comprising:

a top receptacle portion having a top wall, sidewalls, and an openable floor configured to be opened during use as the larger travel bag to provide access into the top receptacle, the top wall and the side walls each comprise multiple layers;

a base having an open base cavity therein that faces upward; and a collapsible chassis attached to the top receptacle portion and the base, the collapsible chassis having a front side wall, a first side wall, a second side wall opposite the first side wall, and a rear side wall, such that the collapsible chassis is extendable and collapsible between an extended position and a retracted position;

the front side wall, the rear side wall, the first side wall, and the second side wall of the collapsible chassis each comprising a single layer and a height that does not extend past a height of a golf bag to be placed within the travel bag when the collapsible chassis is in the extended position and the openable floor of the top receptacle portion being opened, the front side wall of the collapsible chassis having an opening therein that extends vertically between the top receptacle portion and the base with handles attached to the single layered front side wall on either side of the opening in the single layered front side wall and a zipper secured to the front side wall at edges of the opening in the single layer front side wall to open and close the opening in the front side wall of the collapsible chassis; and detaching the top receptacle portion from the base; and extending the collapsible chassis to the extended position to form a larger travel bag so that when the golf bag with clubs therein is placed in the larger travel bag, the golf bag resides in the collapsible chassis with the single layered front side wall, rear side wall, first side wall, and second side wall and heads of the clubs reside in the top receptacle portion with multiple, separable layered top wall and side walls.

18. The method according to claim 17, further comprising:

collapsing the side walls of the collapsible chassis into the cavity of the base into the retracted position; and attaching the top receptacle portion to the base to form a smaller travel bag.

19. The method according to claim 17, further comprising inserting a stiffening rod into the enlarged storage cavity to separate the receptacle portion and the base and extend the side walls of the collapsible chassis to hold the enlarged storage cavity to a size that can house and protect golf clubs within the golf bag.

* * * * *